US006184621B1

(12) United States Patent
Horiuchi et al.

(10) Patent No.: US 6,184,621 B1
(45) Date of Patent: Feb. 6, 2001

(54) PLASMA DISPLAY AND METHOD FOR MANUFACTURING THE SAME

(75) Inventors: Ken Horiuchi; Yuichiro Iguchi; Takaki Masaki; Go Moriya; Yukichi Deguchi, all of Otsu; Kiwame Arizumi, Ibaraki; Yoshiyuki Kitamura, Otsu; Yoshinori Tani, Otsu; Isamu Sakuma, Otsu, all of (JP)

(73) Assignee: Toray Industries, Inc., Chiba (JP)

( * ) Notice: Under 35 U.S.C. 154(b), the term of this patent shall be extended for 0 days.

(21) Appl. No.: 09/297,143

(22) PCT Filed: Aug. 27, 1998

(86) PCT No.: PCT/JP98/03825

§ 371 Date: Apr. 26, 1999

§ 102(e) Date: Apr. 26, 1999

(87) PCT Pub. No.: WO99/10909

PCT Pub. Date: Apr. 3, 1999

(30) Foreign Application Priority Data

Aug. 27, 1997 (JP) ..... 9-230739
May 25, 1998 (JP) ..... 10-142842
May 27, 1998 (JP) ..... 10-146273

(51) Int. Cl.[7] ..... H01J 11/00; H01J 9/02
(52) U.S. Cl. ..... 313/586; 313/581; 445/24
(58) Field of Search ..... 313/586, 581; 445/24, 25, 38

(56) References Cited

U.S. PATENT DOCUMENTS 5,541,479 * 7/1996 Nagakubo ..... 313/586
5,742,122 * 4/1998 Amemiya et al. ..... 313/586 X
5,825,128 * 10/1998 Betsui et al. ..... 313/586 X

FOREIGN PATENT DOCUMENTS 9-102275 * 4/1997 (JP) .
9-320475 * 12/1997 (JP) .
10-188791 * 7/1998 (JP) .
10-302616 * 11/1998 (JP) .

* cited by examiner

*Primary Examiner*—Ashok Patel
(74) *Attorney, Agent, or Firm*—Morrison & Foerster LLP

(57) ABSTRACT

The plasma display of the present invention is a plasma display in which a dielectric layer and stripe-shaped barrier ribs are formed on a substrate, and it is characterized in that there are inclined regions at the lengthwise direction ends of said barrier ribs and, furthermore, the height (Y) of the inclined regions and the length (X) of the base of the inclined regions are within the range $0.5 \leqq X/Y \leqq 100$. Moreover, the method of the present invention for manufacturing a plasma display is characterized in that the aforesaid stripe-shaped barrier ribs are formed via a process in which a pattern of stripe-shaped barrier ribs having inclined regions at the ends is formed on a substrate using a barrier rib paste comprising inorganic material and organic component, and a process in which said barrier rib pattern is fired.

15 Claims, 5 Drawing Sheets

PLASMA DISPLAY AND METHOD FOR MANUFACTURING THE SAME

TECHNICAL FIELD

The present invention relates to a plasma display and to its method of manufacture. Plasma displays can be used for large size televisions and computer monitors.

TECHNICAL BACKGROUND

When compared to liquid crystal panels, high speed display is possible with plasma displays (PDPs) and, furthermore, it is easy to produce large sizes, so they are used in fields such as OA equipment and advertising display devices. Moreover, advances into fields such as high quality televisions is greatly expected.

Along with such broadening of applications, colour plasma displays with numerous fine display cells are attracting attention. Now, taking an AC type plasma display as an example for explanation, plasma discharge is produced between facing anodes and cathodes within discharge spaces provided between a front glass substrate and a rear glass substrate, and the ultraviolet rays generated from a gas sealed within these discharge spaces strike phosphors provided within the discharge spaces, thereby producing the display. A simple structural view of an AC type plasma display is shown in FIG. 1. Here, barrier ribs (also referred to as barriers or ribs) are provided to keep the spread of the discharge within fixed regions and to carry out display within prescribed cells, and also at the same time to secure uniform discharge spaces. In the case of an AC type plasma display, these barrier ribs are formed as stripes.

The barrier ribs are roughly of width 30–80 $\mu$m and height 70–200 $\mu$m and, normally, they are formed to a specified height by the printing of an insulating paste containing glass powder on the front glass substrate or the rear glass substrate by a screen printing method and then drying, and repeating this printing and drying process 10 or more times.

In Japanese Unexamined Patent Publication (Kokai) Nos 1-296534, 2-165538, 5-342992, 6-295676 and 8-50811, methods are proposed for forming the barrier ribs by photolithography using a photosensitive paste.

By all of these methods the barrier ribs are produced by forming an insulating paste containing glass powder in the shape of the barrier rib pattern, and then firing. In such circumstances, due to differences in the firing shrinkage between the upper and lower regions of the barrier ribs, there has been the problem that the ends of the barrier ribs separate from the substrate and spring up as shown in FIG. 4, or the upper portion of the barrier rib swells upwards without separation as shown in FIG. 5.

Where this springing or swelling upwards is at the ends of the barrier ribs, a gap is produced between the front plate and the peaks of the barrier ribs on the rear plate when the front plate and rear plate are brought together and the panel formed. As a result of such a gap, there has been the problem that cross-talk occurs at the time of discharge and disturbance is produced in the picture.

To remedy this, in Japanese Unexamined Patent Publication (Kokai) No. 6-150828 there is proposed the method of giving the barrier ribs a multilayer structure, with the compositions of the upper and lower layers altered, and providing in the lower layer a glass of lower melting point than in the upper layer. Again, in Japanese Unexamined Patent Publication No. 6-15083, there is proposed the method of providing an under glass layer on the underlayer at the ends. However, none of these methods has been adequate in terms of preventing the swelling. Again, in Japanese Unexamined Patent Publication No. 6-150832, there is described a method in which the barrier rib ends are given a stepped form, but the prevention of swelling is inadequate.

DISCLOSURE OF THE INVENTION

The present invention has the objective of providing a high resolution plasma display in which there is no springing up and swelling upwards of the ends, together with a method for the production of said plasma display. Furthermore, the present invention has the objective of providing a high resolution plasma display with little erroneous discharge, together with a method for the production of said plasma display. Plasma display in the present invention denotes a display in which display is effected by discharge within discharge spaces partitioned by the barrier ribs, and as well as the aforesaid AC type display it also includes various types of discharge type display including plasma-addressed liquid crystal displays.

The objectives of the present invention are realized by a plasma display in which a dielectric layer and stripe-shaped barrier ribs are formed on a substrate, said plasma display being characterized in that there are inclined regions at the lengthwise direction ends of said barrier ribs and, furthermore, the height (Y) of the inclined regions and the length (X) of the base of the inclined regions are within the following range.

$$0.5 \leqq X/Y \leqq 100$$

Again, the objectives of the present invention are realized by a method of manufacturing a plasma display in which a dielectric layer and stripe-shaped barrier ribs are formed on a substrate, said method of manufacturing a plasma display being characterized in that stripe-shaped barrier ribs having inclined regions at the lengthwise direction ends of the barrier ribs and, furthermore, where the height (Y) of said inclined regions and the length (X) of the base of the inclined regions are within the range shown below, are formed via a process in which a pattern of stripe-shaped barrier ribs having inclined regions at the ends is formed on a substrate using a barrier rib paste comprising inorganic material and organic component, and a process in which said barrier rib pattern is fired.

$$0.5 \leqq X/Y \leqq 100$$

OPTIMUM CONFIGURATION FOR PRACTISING THE INVENTION

Figure 1:
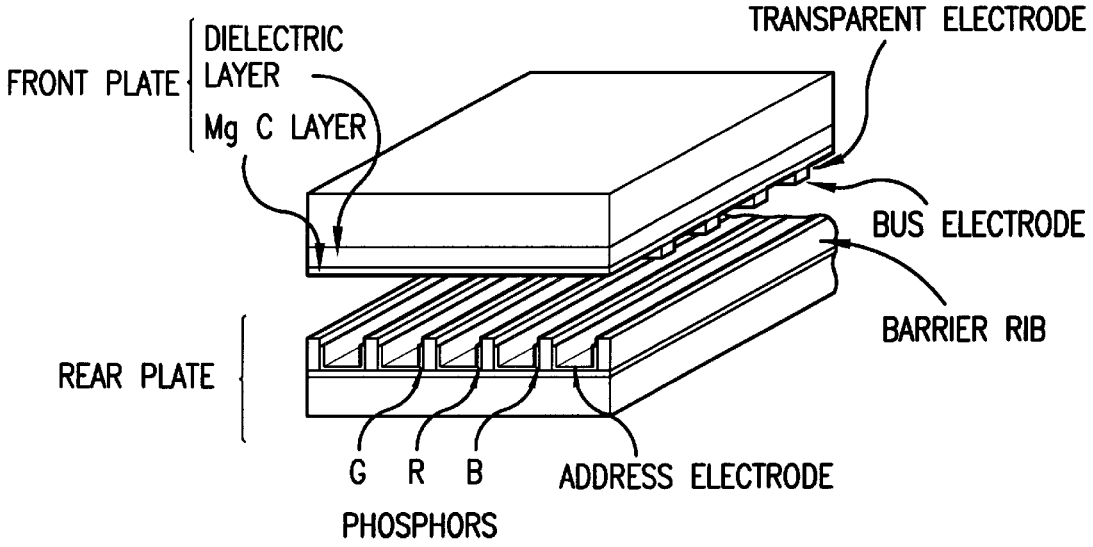
FIG. 1 is a diagram showing the structure of a plasma display.
Figure 2:
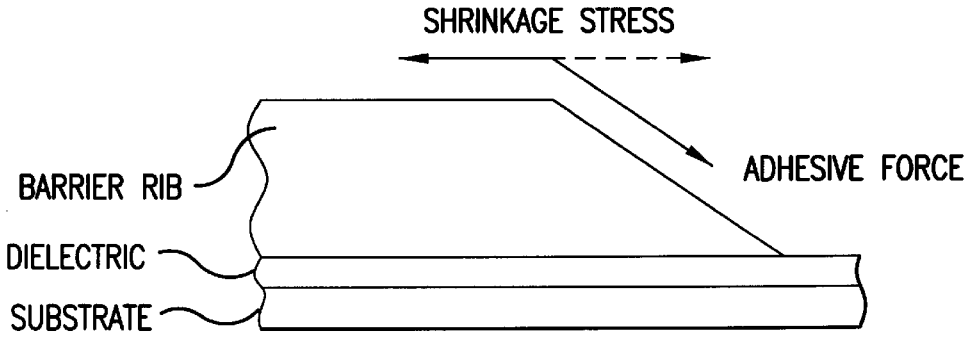
FIG. 2 is a side view showing the shape of the barrier ribs in the present invention.

The plasma display of the present invention needs to has inclined regions at the barrier rib ends. By having inclined regions at the barrier rib ends, it is possible to mitigate shrinkage stress at the top of the barrier ribs and stress originating in the adhesive force, as shown in FIG. 2, and so it is possible to prevent the springing and swelling upwards.

Figure 3A:
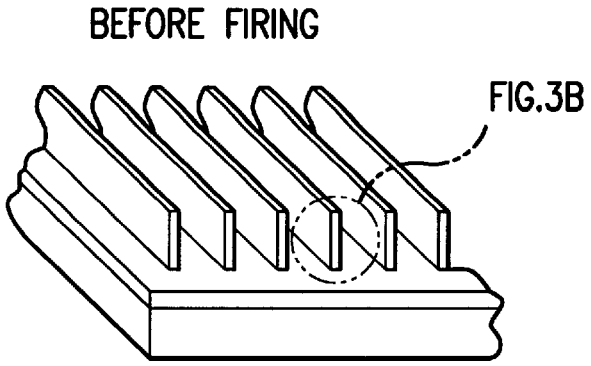
FIG. 3 is a side view showing the shape of conventional barrier ribs.
Figure 3B:
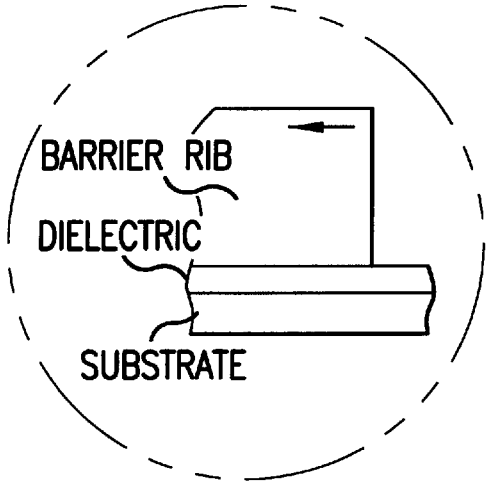
Figure 4:
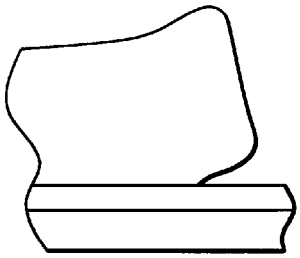
FIG. 4 is a side view showing the form of the springing up of the barrier ribs following firing.

It is assumed that the phenomenon of springing up (FIG. 4) or swelling upwards (FIG. 5) occurs due to the difference in shrinkage stress in the case where there is no inclined region at the barrier rib ends, since the upper portion of the barrier ribs can shrink freely at the time of shrinkage due to firing whereas the lower portion is bonded to the substrate as shown in FIG. 3.

The inclined region may be of any shape so long as there is provided an incline, examples being (1) a straight line, (2) a convex curve, (3) a concave curve, and (4) one in which a plurality of straight lines is connected.

Furthermore, it is preferred, in terms of eliminating unevenness in the gap between the front plate and the rear plate at the time of the sealing of the panel, that inclined regions be formed at both ends of the barrier ribs.

Figure 6:
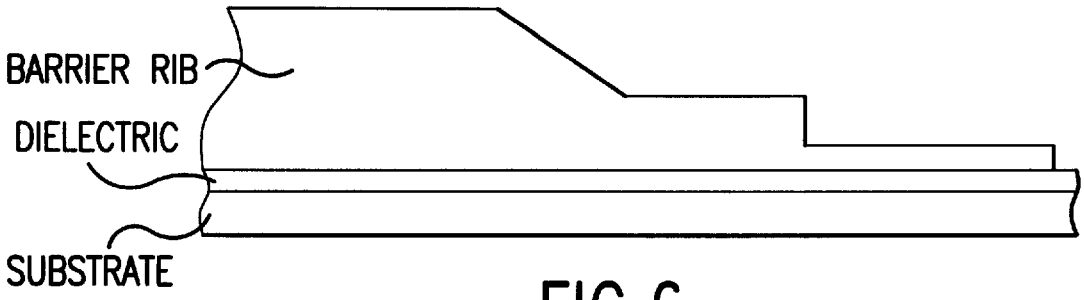
FIG. 6, FIG. 7 and FIG. 8 are side views showing examples of the barrier rib shape in the present invention.

Again, the inclined region may be combined with a step shape as in FIG. 6. However, it is preferred that the height of the portion which is not inclined be no more than 50 $\mu$m. With a step shape having a right angled region, it is not possible to achieve a shrinkage stress balance, so the greater the height thereof the greater is the extent of springing or swelling upwards. Providing it is no more than 50 $\mu$m, then there is little swelling and, when a panel of size 20 inches or more is formed, the front plate and barrier ribs adhere closely and cross-talk does not readily occur. In the case where a step shape and an inclined region are combined, it is further preferred that the inclined region be provided on the uppermost portion of the barrier rib. It is possible to eliminate swelling by having the inclined region at the top.

Figure 7:
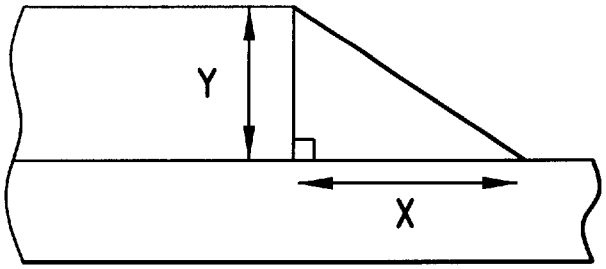

It is preferred that the height of the aforesaid inclined region (Y) and the length of the base of the inclined region (X) (FIG. 7) lie in the following range.

$$0.5 \leqq X/Y \leqq 100$$

Again, it is preferred that the length (X) of the base of the inclined region is from 0.05 to 50 mm. It is undesirable for X to exceed 50 mm, since the inclined region is lower than the desired barrier rib height and picture disruption is produced. More preferably it is no more than 10 mm and still more preferably no more than 5 mm. If it is less than 0.05 mm, then there is little effect, in terms of suppressing springing up and swelling, by the formation of the inclined region.

Figure 8:
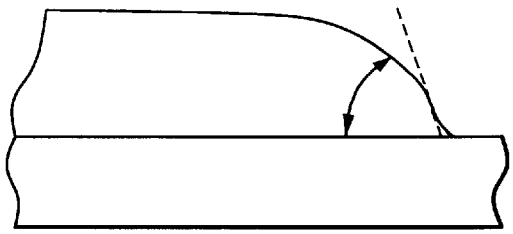

Again, in the present invention, it is preferred that the angle of inclination of the inclined region of the barrier rib be 0.5 to 60°. Where the incline is not on a straight line then, as shown in FIG. 8, the angle of the portion of maximum incline is taken as the angle of inclination. If the angle of inclination is less than 0.5°, then the inclined region becomes too long, so this is undesirable in terms of panel design, whereas at more than 60° it is not possible to suppress separation adequately at the time of firing. The preferred range is 20 to 50°.

Since the springing up or swelling upwards occur at the time of firing, it is preferred that the inclined region be formed prior to the barrier rib firing.

If the shrinkage factor of the barrier rib paste at the time of firing is taken as r, then, since the firing shrinkage is marked in the height direction but practically does not occur at all in the barrier rib lengthwise direction, if the height of the inclined portion prior to firing is taken as Y' and the length of the inclined portion is taken as X', we get $Y=r\times Y'$ and $X\approx X'$. Consequently, in order that the barrier rib shape after firing lies within the range of the present invention, the preferred shape at the ends of the barrier rib pattern prior to firing is $0.5 \leqq X'/(Y'\times r) \leqq 100$.

In such circumstances, where the height Y' of the inclined region prior to firing is from 0.2 to 1 times the height of the barrier rib pattern prior to firing, this is effective for preventing swelling of the barrier rib end regions. With less than 0.2 times, it is not possible to mitigate differences in firing shrinkage stress between the barrier rib top portion and bottom portion, and so it is not possible to prevent swelling. Again, where the heights are made equal, then there may be damage to the dielectric or to the electrodes provided on the substrate during the processing to form the inclined region, so no more than 0.9 is preferred. Still more preferred is the range 0.3 to 0.8 times.

The method of measuring the shape of the inclined region is not particularly restricted but measurement using an optical microscope, a scanning electron microscope or laser microscope is preferred.

For example, the following method is preferred in the case where a scanning electron microscope (Hitachi S-2400) is used. Cutting is carried out such that the barrier rib inclined region is accurately presented and then it is machined to an observable size. The magnification in the measurement is selected such that the inclined region lies in the field of view. Then a photograph is taken after calibrating the scale with a standard material of size of the same order as the inclined region. The lengths of X and Y are measured by a method as in FIG. 7, and the shape is calculated from the scale.

In the case where it is desired to carry out the measurement in a non-destructive fashion, there may be used a laser focus displacement gauge (for example LT-8010 made by Keyence). Here too it is preferred that measurement be carried out after calibrating with a standard material in the same way. In such circumstances, it is preferred for conducting accurate measurement that it be confirmed that the laser measurement plane is parallel to the barrier rib stripe direction.

In the method of manufacturing the plasma display of the present invention, stripe-shaped barrier ribs having a sloping region at the lengthwise direction ends of the barrier ribs are formed via a process in which a stripe-shaped barrier rib pattern with sloping regions at the ends is formed on the substrate using a barrier rib paste comprising inorganic material and organic component, and a process in which this barrier rib pattern is fired. The method for forming the inclined region at the barrier rib ends is not particularly restricted but the following methods can be employed.

One method is the method whereby, when applying the glass paste used for the barrier ribs on the substrate, application is carried out in such a way that the ends of the applied film are formed with an inclined face, and then the barrier rib pattern is formed in such a way that the inclined faces of the applied film form the lengthwise direction ends of the stripe-shaped barrier rib pattern. The method of application is not particularly restricted but the use of screen printing, a roller coater, a doctor blade or a slit die coater by discharge from a die, is preferred.

As the barrier rib pattern formation method, there can be used the screen printing method, the sandblasting method, the lift off method, the photolithography method or the like.

In particular, in the case where the formation of the barrier rib pattern is carried out by the photo-lithography method, the aforesaid applied film with inclined faces is exposed to light through a photo mask with a stripe-shaped pattern, and then the stripe-shaped barrier rib pattern is formed by developing, and in such circumstances by performing the light exposure through a photo mask having a stripe-shaped pattern longer than the length of the applied film with inclined faces at the ends, it is possible to obtain a stripe-shaped barrier rib pattern with inclined regions at the ends. This method does not require after-processing and the inclined regions can be formed without increasing the number of stages.

Another method is the method whereby, following application of the glass paste used for the barrier ribs on the substrate, the applied film is processed to form inclined faces, and then the barrier rib pattern is formed in such a way that the inclined faces of this applied film form the lengthwise direction ends of the stripe-shaped barrier rib pattern.

Figure 9:
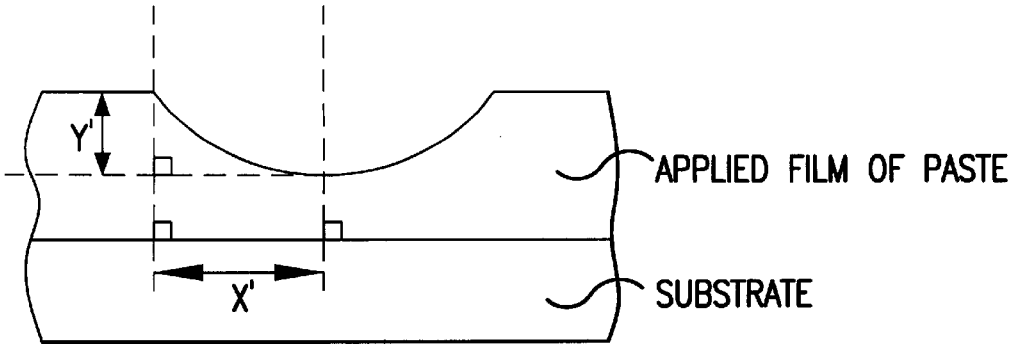
FIG. 9 is a cross-sectional view showing an example of an inclined face formed on the applied film of paste used for the barrier ribs.

Any method may be used for processing the applied film to form the inclined faces, but it is preferred that the inclined faces be formed by the jetting of a fluid against the applied film. Specifically, by the jetting of a fluid against an applied film which has not be completely dried and hardened and which retains fluidity, there is formed a sloping face as shown in FIG. 9.

Any fluid can be employed in this method providing that it is a liquid or gas at the working temperature but it is preferred that it be a fluid which does not remain on the substrate following the firing stage and with which work can be carried out cleanly. The preferred fluid is a gas in that it is clean and does not require a recovery process. The gas components are not particularly restricted but, from the point of view of cost, air or nitrogen is ideally employed. In the case where a gas is used as the fluid, it is preferred that the inclined faces are formed by directing a jet of the gas onto an applied film which has not been completely dried and cured and which retains fluidity. Again, the use of a solvent as the fluid is also preferred. In the case where a solvent is employed as the fluid, precise processing is possible by forming the inclined faces by directing a jet of solvent at the applied film following drying and curing.

The use of a nozzle or slit is preferred for the jetting of the fluid. The internal diameter of the nozzle and the slit spacing are preferably from 0.01 mm to 3 mm respectively. At less than 0.01 mm, the required flow level is not obtained at the time of the fluid jetting and it is not possible to form an inclined face. If it exceeds 3 mm, then positional control of the fluid jet is difficult.

Machining by mechanical cutting is also a good method for forming inclined faces by the processing of the applied film. Here reference to cutting includes cutting with a cutting tool, grinder or similar such item, cutting by sandblasting, and burning away by means of laser irradiation. The amount of cutting depends on the thickness of the applied film, and it is preferably from 10–90% of the applied film thickness, in particular from 50–80%. If the amount of cutting is too great, then there is a fear of scraping the substrate, while if it is too small then areas which cannot be cut are produced due to the effects of unevenness in the applied film thickness. Cutting after drying and hardening the applied film does not produce swelling due the cutting, and so is preferred. Moreover, this method can be employed after curing with heat or ultraviolet. It can also be applied to the case where the applied film is subjected to pattern exposure with ultraviolet light by the photolithography method, and partially hardened regions produced.

The cutting rate may be decided by observing the state of the cut cross-section, but from 0.05 to 10 m/minute is preferred.

With regard to the material of the cutting tool or grinder, any material can be employed which is used as a cutting material, such as for example ceramic, high speed steel or super steel.

In the case where the applied film is obtained by application of a photosensitive paste, and the barrier rib pattern formation is carried out by photolithography, cutting in a process following exposure and prior to development is also preferred. In this way, the cutting dust is washed away by means of the development process and it is possible to simply prevent any problems caused by cutting dust.

In the case where the lift-off method is used in the barrier rib pattern formation, it is preferred that a resin mould be filled with the barrier rib paste and drying and curing performed, after which the resin mould and the applied film of barrier rib paste are simultaneously cut. By performing simultaneous cutting, it is possible to prevent collapse of the barrier rib pattern. Furthermore, since both the cutting dust and the resin mould can be removed together in the removal stage, this is also advantageous in preventing faults. The lift-off method comprises forming a resin mould as a barrier rib pattern mould by means of a photosensitive resin on a glass substrate, and then filling this with the barrier rib paste. Next, after drying the barrier rib paste, the resin mould is removed and the barrier rib pattern formed, and by firing said barrier rib pattern the barrier ribs are formed.

In the case where there is used the sandblasting method in the formation of the barrier rib pattern, after removing the unnecessary parts by sandblasting, cutting may be carried out along with the resist layer. This is advantageous in preventing faults in that, when the resist layer is eliminated, it is possible at the same time to eliminate the cutting dust. The sandblasting method is a method in which a resist layer is applied onto an applied film of the barrier rib paste, and then said resist layer exposed and developed to form a barrier rib pattern mask. Then, the barrier rib pattern is formed by eliminating the unnecessary areas by sandblasting, after which the resist layer is removed and the barrier rib pattern is fired to form the barrier ribs.

Figure 10:
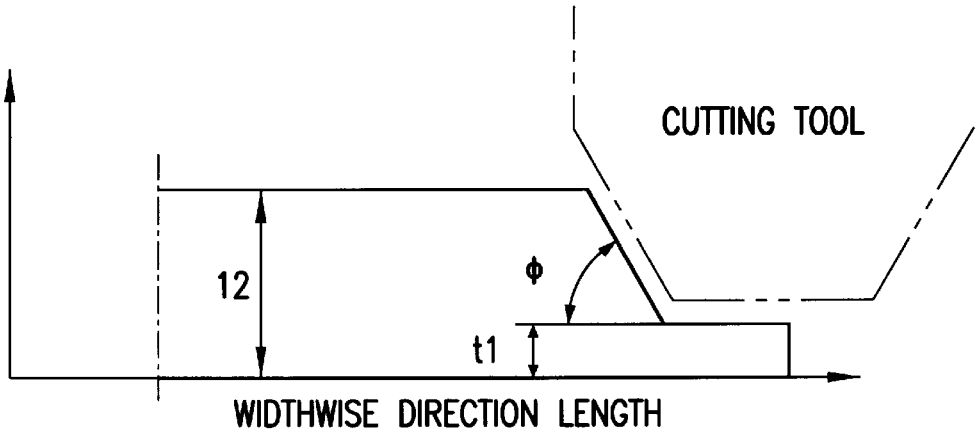
FIG. 10 is a cross-sectional view showing the relation between the shape of the cutting tool or grinder and the shape of the applied film end cut out thereby.
Figure 11:
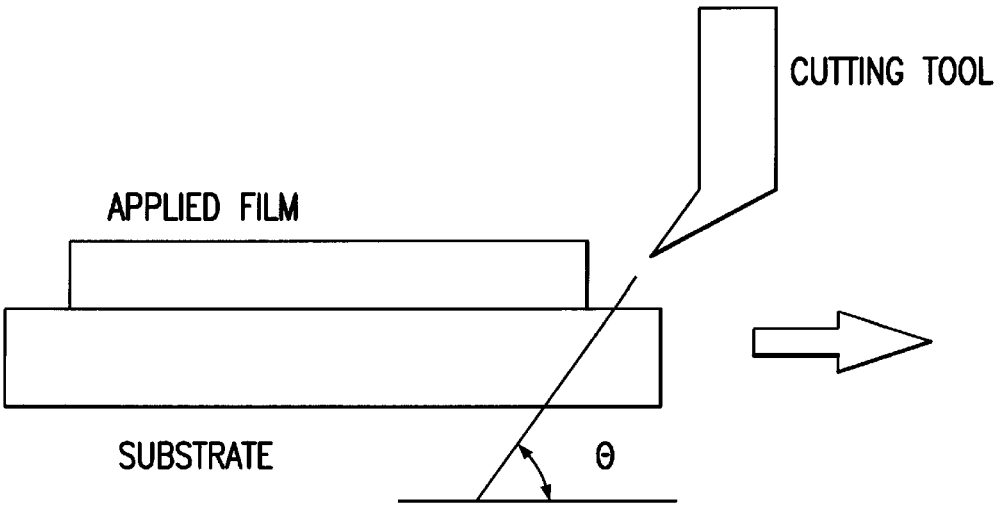
FIG. 11 and FIG. 12 are examples of methods of forming an inclined face by cutting the ends of the applied film with a cutting tool, which are preferred production methods of the present invention.
Figure 12:
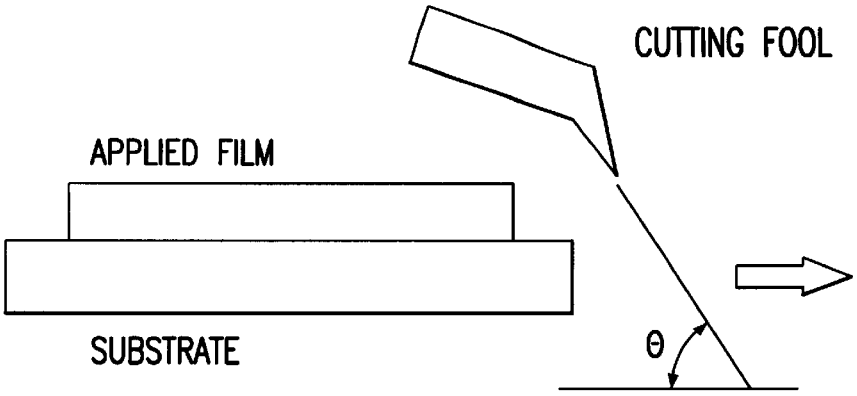

FIG. 10 shows an example of a preferred form of the end of the applied film where an inclined face has been formed by cutting. If the height of the region without an inclined face is taken as $t_1$, the applied film thickness as $t_2$ and the angle of inclination of the inclined face as $\phi$, then the preferred ranges are $t_1/t_2$=0.1 to 0.8 and $\phi$=0.1 to 60°. Thus, there may be used a cutting tool or grinder formed to have a shape which matches the desired shape of the inclined face (for example the shape shown by the dashed lines in FIG. 10). At the time of cutting, the substrate may be fixed and the cutting means such as the cutting tool or grinder moved, or the cutting means is fixed and the substrate moved. FIG. 11 and FIG. 12 show views seen from the side of FIG. 10 in the case where there is used a cutting tool. Here, the cutting tool is fixed and the substrate is moved in the arrowed direction. The angle of the cutting tool in terms of the substrate may be arranged so that it faces the substrate as shown in FIG. 11, or as shown in FIG. 12 the cutting tool may be made to cover the substrate. Selection should be made in accordance with the properties of the applied film. In either case, the angle Θ between the cutting tool and substrate is preferably from 10 to 80°, and in particular from 15 to 60°.

In the case of cutting by sandblasting or burning away with a laser, the sandblasting jetting angle or the laser irradiation angle are important, but the angle may be set so as to match the desired shape of the inclined face. The preferred angle is from 0.1 to 60° in the same way as above.

Moreover, it is preferred that the cutting dust generated by the cutting of the applied film be forcibly removed. This forcible elimination of the cutting dust is preferably carried out by applying suction to the cutting dust. In this way, the dust is prevented from re-sticking to the surface of the applied film and panel defects are prevented. Now the suction pressure of the device used for applying suction is preferably from 10 to 500 hPa.

Furthermore, the relative position of the aforesaid cutting tool or grinder in terms of the applied film may be varied in accordance with the applied film profile so that the film thickness shape is always constant. In the case of the formation of a barrier rib pattern on a glass substrate of diagonal 20 inches or more, undulations of the tens of micron order are present on the substrate. By having a fixed distance between the cutting tool or grinder and the substrate, cutting of the dielectric or electrodes is prevented and so defects are prevented.

As a means of processing the applied film to provide an inclined face, dissolving with a solvent may be also performed. Specifically, a cloth or the like is impregnated with a solvent and, by rubbing the applied film with this, an inclined face is formed. Again, the inclined face may be formed by pressing a wedge-shaped stamp against the applied film.

In particular, in the case where the formation of the barrier rib pattern is carried out by photolithography, by using a photo mask having a stripe-shaped pattern longer than the length of the applied film with inclined faces as the ends, it is possible to obtain a stripe-shaped barrier rib pattern having inclined regions at the ends.

Now, the length of the applied film with inclined faces as the ends is the applied film length in the case where the inclined faces are regarded as the terminal regions. At the time of the processing of the applied film, in the case where an unnecessary portion of the applied film (below referred to as the applied film remnant) is left beyond the formed inclined face, this applied film remnant is not included in the length of the applied film with inclined faces as the ends. The applied film remnant is removed from the substrate in a subsequent stage such as in the developing process. For example, FIG. 9 shows the formation of an inclined face on the applied film. The left side in the figure is the applied film, while the right side is the region outside of the applied film, and in the present invention it is the broken line on the left of drawing which is regarded as the end of the applied film length. Again, to the right of the right hand side broken line in the drawing is the unnecessary applied film remnant. Here, by using a photo mask of length longer than the length of the applied film with an inclined face at the end, a length which does not include the applied film remnant, ie where the end of the pattern lies between the left and right broken lines in the drawing, the applied film remnant is not exposed, so it is eliminated at the time of developing and there is obtained only the barrier rib pattern with inclined regions at the ends.

Again, the inclined regions may also be formed by processing after forming the barrier rib pattern but, in terms of the ease of processing and reducing the number of stages, it is preferred that the formation of the barrier rib pattern be carried out after forming the inclined regions as described above.

As another method for forming the inclined regions at the ends of the barrier ribs there is the method which includes a process wherein a barrier rib mould in which stripe-shaped grooves have been formed is filled with a barrier rib paste comprising inorganic material and organic component, a process in which the barrier rib paste filled in this barrier rib mould is transferred onto a substrate, and a process in which said barrier rib paste is fired at 400–600° C., in that order.

That is to say, it is a method in which grooves corresponding to the barrier rib pattern are formed beforehand in the barrier rib mould, then these are filled with a barrier rib glass paste, and said paste transferred from the barrier rib mould onto a glass substrate, to form the barrier rib pattern. In this method, after filling the barrier rib mould with the glass paste, this is transferred onto a glass substrate to form the barrier rib pattern, and by performing the transfer with the application of pressure at the time of the transfer, transfer faults do not readily occur. Again, by performing the transfer while heating, separation of the paste from the barrier rib mould is facilitated. Moreover, in the case where the organic component in the glass paste contains a component which undergoes thermal polymerization, a volume change occurs due to the polymerization shrinkage so separation from the mould is facilitated.

In this method, the inclined regions may also be formed at the barrier rib pattern ends by an aforesaid method for forming an inclined face following the formation of the barrier rib pattern, but if inclined regions are provided at the ends of the grooves formed in the barrier rib mould beforehand, no after-processing is then required and the inclined regions can be produced without any increase in the number of stages, so this is preferred.

Yet another method is the method containing a process in which an applied film is formed by application of a barrier rib paste comprising inorganic material and organic component onto the substrate, a stage in which the barrier rib pattern is formed by pressing a barrier rib mould in which stripe-shaped grooves have been formed against the applied film, and a process in which said barrier rib pattern is fired at 400–600° C., in this order.

This method is a method in which the barrier rib pattern is formed by uniformly applying beforehand the barrier rib glass paste over a part or all of the glass substrate, and then pressing a barrier rib mould against this applied layer of paste. The method for uniformly applying the glass paste onto the glass substrate is not particularly restricted, but preferred examples are the screen printing method or coating methods using a die coater or roll coater.

In the same way as above, in this method it is preferred that the formation of the inclined regions be performed beforehand at the ends of the grooves formed in the barrier rib mould.

Figure 13:
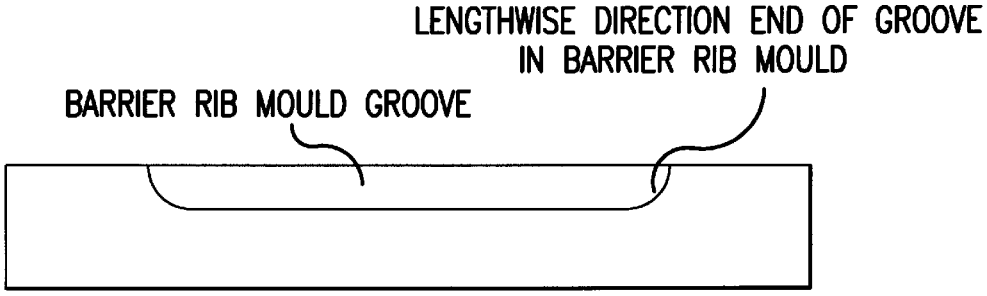
FIG. 13 is a cross-sectional view of a barrier rib mould preferably used in the production method of the present invention.

FIG. 13 is a cross-sectional view of a barrier rib mould preferably used in the aforesaid production methods, and there are inclined regions at the lengthwise direction ends of the grooves formed in the barrier rib mould. Preferred examples of the material from which this barrier rib mould is composed are polymer resins and metals. In the former method of production, a barrier rib mould made of silicone rubber can be favourably used, while in the latter method of production there can favourably be, used a barrier rib mould produced by the pattern etching of a metal plate or pattern grinding employing a grinding agent.

In addition to having inclined regions at the ends, giving the barrier ribs a multilayer structure and using a glass with a lower softening point in the lower layer than in the upper layer is also preferred since the adhesive strength can be raised. By increasing the adhesive strength to the underlayer, springing-up can be prevented.

Taking the lower face width as $L_b$, the width at half the height as $L_h$ and the upper face width as $L_t$, it is preferred that the barrier ribs for the plasma display of the present invention satisfy the following ranges.

$$L_t/L_h=0.65 \text{ to } 1$$

$$L_b/L_h=1 \text{ to } 2$$

Now, $L_b$ is the width at the bottom of the barrier rib, $L_h$ is the width at half the height (taking the barrier rib height as 100, it is the line width at a height of 50 from the bottom face), and $L_t$ is the width at the top of the barrier rib.

If $L_t/L_h$ is greater than 1, then the shape is such that a narrowing is produced in the barrier rib centre, and since the ratio of discharge space to barrier rib pitch, that is to say the aperture factor, becomes smaller, the luminance is lowered. Furthermore, when forming the phosphors, application unevenness, that is to say thickness unevenness and non-uniformity results. Again, if it is less than 0.65, the upper face is too thin and the strength is insufficient to withstand the atmospheric pressure applied at the time of panel formation, so that crushing of the tip readily occurs. Where $L_b/L_h$ is less than 1, this is undesirable in that the strength is lowered and it is a cause of barrier rib collapse or meandering. Again, if it greater than 2 then the luminance is reduced due to a reduction in discharge space.

More particularly, the ranges $L_t/L_h$=0.8 to 1 and $L_b/L_h$=1 to 1.5 are excellent in terms of securing the aperture factor, and so are preferred. However, in the case where $L_t=L_h=L_b$, the strength is poor and collapse readily occurs, so this is undesirable. With regard to the shape, a trapezoidal or rectangular shape which is free of narrowing at the bottom face of the barrier rib is preferred in terms of strength.

Furthermore, by giving the barrier rib pattern prior to firing an aforesaid shape, in particular the area of contact with the substrate glass or dielectric layer is broadened, so that shape retentivity and stability are enhanced. As a result, separation or snapping following firing is overcome.

It is preferred that the porosity of the barrier ribs in the present invention be no more than 10%, and more preferably no more than 3%, so as to prevent barrier rib collapse and so that there is outstanding adhesion to the substrate. Taking the true specific gravity of the barrier rib material as $d_{th}$ and the measured density as $d_{ex}$, the porosity (P) is defined as follows.

$$P=(d_{th}-d_{ex})/d_{th}\times 100$$

The true specific gravity of the barrier rib material is preferably calculated as follows using the so-called Archimedes method. The barrier rib material is pulverized using a mortar so that it is about mesh size 325 or below and so that it can no longer be felt with the finger tip. The true specific gravity is then determined in accordance with JIS-R2205.

Next, with regard to the measured density, measurement is carried out using the Archimedes method in the same way, except that the barrier rib portion is cut out in such a way that its shape is not destroyed and no pulverizing is performed.

If the porosity is greater than 10%, as well as the adhesive strength being lowered, the strength is inadequate and, furthermore, there is a reduction in the light emission characteristics such as a lowering of the luminosity due to absorption of gas and moisture issuing from the pores at the time of discharge. Taking into account the panel discharge life, luminosity stability and other light emission characteristics, it is still more preferably no more than 1%.

In the case where used as the barrier ribs of a plasma display or a plasma-addressed liquid crystal display, the pattern forming is carried out on a glass substrate of low glass transition point or softening point, so there is preferably employed as the barrier rib material a glass of glass transition temperature 430–500° C. and softening point 470–580° C. If the glass transition point is higher than 500° C. and the softening point higher than 580° C., the firing has to be carried out at a high temperature and strain is produced in the substrate at the time of the firing. Again, with a material of glass transition point lower than 430° C. and softening point lower than 470° C., a dense barrier rib layer is not obtained, and separation, snapping and meandering of the barrier ribs are brought about.

The measurement of the glass transition point and of the softening point is preferably carried out as follows. Using the differential thermal analysis (DTA) method, the glass sample material is heated in air at 20° C./minute and a DTA thermogram traced out with temperature on the horizontal axis and the quantity of heat on the vertical axis. From the DTA thermogram, the glass transition point and softening point are read off.

Moreover, since the coefficient of thermal expansion of the usual high strain point glass employed as the substrate glass is from 80 to $90\times10^{-7}$/K, it is preferred, in order to prevent substrate warping and cracking at the time of panel sealing, that there be used for the barrier ribs and the dialectic layer a glass material of coefficient of thermal expansion between 50 and 400° C. ($\alpha_{50-400}$) of 50 to $90\times10^{-7}$/K, and more preferably 60 to $90\times10^{-7}$/K. By using a glass material with the above characteristics, it is possible to prevent barrier rib separation and snapping.

With regard to the composition of the barrier rib material, it is preferred that silicon oxide be incorporated within the range 3 to 60 wt % in the glass. If there is less than 3 wt %, then the compactness, strength and stability of the glass layer are lowered, and the coefficient of thermal expansion deviates from the desired value, so that mis-match with the substrate tends to occur. Again, by employing no more than 60 wt %, there is the advantage that the softening point is lowered and there is the possibility of firing onto the glass substrate.

By incorporating boron oxide into the glass in the range from 5 to 50 wt %, it is possible to enhance the electrical, mechanical and thermal properties such as the electrical insulation, strength, coefficient of thermal expansion and compactness of the insulating layer. With more than 50 wt %, the stability of the glass decreases.

By using a glass powder containing from 2 to 15 wt % of one or more of lithium oxide, sodium oxide and potassium oxide, it is possible to obtain a photosensitive paste with temperature characteristics that enable pattern processing to be carried out on a glass substrate. The added amount of this oxide of an alkali metal such as lithium, sodium and potassium is preferably no more than 15 wt %, in that it is possible to enhance the paste stability by using no more than 15 wt %.

The composition of a glass containing lithium oxide is preferably as follows, expressed by conversion to the oxide.

| | |
|---|---|
| lithium oxide | 2–15 wt % |
| silicon oxide | 15–50 wt % |
| boron oxide | 15–40 wt % |
| barium oxide | 2–15 wt % |
| aluminum oxide | 6–25 wt % |

Again, sodium oxide or potassium oxide may be used instead of the lithium oxide in the aforesaid composition, but from the point of view of paste stability lithium oxide is preferred.

Moreover, by means of a glass containing both a metal oxide such as zinc oxide, bismuth oxide or lead oxide, and an alkali metal oxide such as lithium oxide, sodium oxide or potassium oxide, control of the softening point and coefficient of linear thermal expansion is easier at a lower alkali content. When a dielectric layer is provided between the substrate and the barrier ribs, it is possible to improve the adhesion of the barrier ribs and prevent separation in comparison to the case where they are formed directly on the substrate.

The thickness of the dielectric layer is preferably from 5 to 20 $\mu$m and more preferably from 8 to 15 $\mu$m, in terms of the formation of a uniform dielectric layer. If the thickness exceeds 20 $\mu$m then, at the time of firing, the removal of the organic component is difficult and cracks are readily produced and, furthermore, the stress applied to the substrate is large, so there is the problem that the substrate warps. Moreover, with less than 5 $\mu$m it is difficult to secure thickness uniformity.

If the barrier rib pattern and the applied film used for the dielectric layer are simultaneously fired following the formation of the barrier rib pattern on the applied film used for the dielectric layer, then removal of the binder from the applied film used for the dielectric layer and from the barrier rib pattern occur at the same time so the shrinkage stresses due to removal of the binder from the barrier rib pattern are mitigated, and it is possible to prevent separation and snapping. In contrast, in the case where the applied film used for the dielectric layer is first of all fired by itself, after which the barrier rib pattern is formed thereon and firing carried out; separation and snapping more readily occur at the time of firing due to inadequate adhesion between the barrier ribs and the dielectric layer. Moreover, when the barrier rib pattern and the applied film used for the dielectric layer are fired simultaneously, there is also the advantage that fewer stages are involved.

In the case of the simultaneous firing method, if, following the formation of the applied film used for the dielectric layer, the film is then cured, it is not eroded by the developer liquid in the barrier rib pattern forming process, so this is preferred. For the curing of the applied film used for the dielectric layer, a photocuring method whereby a photosensitive material is employed in the dielectric layer paste, then the paste applied onto the glass substrate and drying performed, after which exposure to light is carried out, is a simple method and is favourably used.

Again, it is possible to cure the applied film by means of thermal polymerization. The method adopted in such circumstances may be to add radically polymerizable monomer and radical polymerization initiator to the dielectric layer paste, followed by application of the paste, and then heating.

It is also possible not to carry out curing of the applied film used for the dielectric layer but, when compared to the case where curing is carried out, the applied film is susceptible to erosion by the developer liquid in the barrier rib pattern formation process, and cracks are readily produced in the dielectric layer. Consequently, a polymer which is not soluble is the developer must be selected.

The dielectric layer in the present invention will preferably have, as its chief component, a glass of $\alpha_{50-400}$ value, that is to say coefficient of thermal expansion in the range 50–400° C., of 70 to $85\times10^{-7}$/K, and more preferably 72 to $80\times10^{-7}$/K, so as to conform with the coefficient of thermal expansion of the substrate glass and to reduce stresses on the glass substrate at the time of firing. Here, chief component means at least 60 wt % and preferably at least 70 wt % of the total components. If the value exceeds $85\times10^{-7}$/K, then a stress which causes warping of the substrate is applied to the side on which the dielectric layer is formed, while if the value is less than $70\times10^{-7}$/K, then a stress which causes warping of the substrate is applied to the side with no dielectric layer. Thus, if the substrate is subjected to repeated heating and cooling, splitting of the substrate may occur. Again, at the time of the sealing with the front substrate, said sealing may be impossible where both substrates are not parallel due to substrate warping.

The amount of aforesaid warping of the plasma display substrate in the invention is inversely proportional to the radius of curvature R of the substrate, so it can be specified by the reciprocal of the radius of curvature of the substrate (ie by 1/R). Here, a positive or negative value for the amount of warping expresses the direction of substrate warping. The radius of curvature of the glass substrate can be measured by various methods, but the simplest is the method of measuring undulation of the substrate face using a surface roughness meter (Surfcom 1500A made by the Toyo Seimitsu Co.; or the like). The amount of warping 1/R can be calculated using the following formula from the maximum deviation H in the undulation curve obtained and the measured length.

$$1/R=8H/L^2$$

In cases where warping of the substrate is produced, a gap occurs between the tops of the barrier ribs and the front plate surface at the time of the sealing of the front plate and rear plate, so that erroneous discharge takes place between cells and there is substrate damage at the time of sealing. In order that such problems do not occur, it is necessary that the absolute value of the warping be no more than $3\times10^{-3}$ m$^{-1}$. That is to say, the amount of warping of the substrate needs to lie within the following range $$-3\times10^{-3}\ \mathrm{m}^{-1}\leqq 1/R\leqq 3\times10^{-3}\ \mathrm{m}^{-1}$$

(where R is the radius of curvature of the substrate)

In the present invention, it is possible to prevent substrate warping at the time of firing and cracking at the time of panel sealing by essentially not including alkali metal in the dielectric layer. In the present invention, substantially not including means that there is an alkali metal content of no more than 0.5 wt % and preferably no more than 0.1 wt % in the inorganic material. Again, in terms of the matching of the coefficient of thermal expansion with that of the substrate glass, if the content of alkali metal such as Na (sodium), Li (lithium) or K (potassium) in the dielectric is greater than 0.5 wt %, then ion exchange occurs with the glass substrate or with the glass component in the electrodes at the time of firing, so that the coefficient of thermal expansion in the surface region of the substrate or in the dielectric layer is altered, and there is a mis-match between the coefficients of thermal expansion of the dielectric layer and the substrate, with the result that a tensile stress is produced in the substrate and this leads to cracking of the substrate. Again, it is further preferred that there be essentially no alkali earth metal present.

The dielectric layer in the present invention is preferably at least two layers. A two-layer structure comprising a dielectric layer formed on the electrodes on the glass substrate (referred to as dielectric layer A) and a dielectric layer formed on said dielectric layer A (referred to as dielectric layer B) is preferred. For example, in the case where silver is used for the electrodes, sometimes the problem arises that an ion-exchange reaction or the like occurs between the components in the dielectric layer A and the silver ions or components on the glass substrate, so that the dielectric layer A is discoloured. In particular, in the case where dielectric layer A contains alkali metal and oxide thereof, this ion-exchange reaction may be especially marked, with the dielectric layer A turning yellow. In order to resolve this problem, it is preferred in the present invention that dielectric layers A and B be inorganic materials which are substantially free of alkali metal.

By using a glass containing 10 to 60 wt % of at least one of the group comprising bismuth oxide, lead oxide and zinc oxide, and more preferably bismuth oxide, as the dielectric layer in the present invention, there is ready control of the heat softening temperature or the coefficient of thermal expansion, so this is preferred. In particular, using a glass containing 10 to 60 wt % of bismuth oxide is advantageous in terms of paste stability. If the amount of bismuth oxide, lead oxide or zinc oxide added exceeds 60 wt %, the heat resistance temperature of the glass is too low and firing onto the substrate is difficult.

As a specific example of the glass composition, there is glass with the following composition, expressed by conversion to the oxide, but the present invention is not to be restricted to this glass composition.

| | |
|---|---|
| bismuth oxide | 10–60 wt % |
| silicon oxide | 3–50 wt % |
| boron oxide | 10–40 wt % |
| barium oxide | 5–20 wt % |
| zinc oxide | 10–20 wt % |

Titanium oxide, alumina, silica, barium titanate, zirconia or other such white filler is used as inorganic material contained in the dielectric layer of the present invention. Inorganic material containing 50–95 wt % of glass and 5 to 50 wt % of filler is used. By including an amount of filler in this range, the reflectivity of the dielectric layer is raised and there is obtained a plasma display of high luminosity.

The dielectric layer of the present invention can be formed by the application of a dielectric paste comprising inorganic material powder and organic binder onto the glass substrate, or by layering thereof, and then firing. The amount of inorganic material powder used in the paste for the dielectric layer is preferably from 50 to 95 wt % in terms of the sum of the inorganic material powder and organic component. With less than 50 wt %, the dielectric layer lacks compactness and there is poor surface flatness, while with more than 95 wt % the paste viscosity is raised and there is considerable thickness unevenness at the time of application of the paste.

The method of producing the barrier ribs in the present invention is not particularly restricted but the photosensitive paste method is preferred in that there are fewer stages and fine pattern formation is possible.

The photosensitive paste method is a method in which an applied film is formed using a photosensitive paste comprising inorganic material in which glass powder is the chief component and an organic material which possesses photosensitivity, and then said applied film is subjected to light exposure through a photo mask and developed, to form the barrier rib pattern, after which this barrier rib pattern is fired and the barrier ribs obtained.

The amount of inorganic material used in the photosensitive paste method is preferably from 65 to 85 wt % in terms of the sum of the inorganic and organic material.

If it is less than 65 wt %, there is considerable shrinkage at the time of firing, which leads to snapping or separation of the barrier ribs, so this is undesirable. Moreover, the paste is difficult to dry and tackiness is produced, so that the printing characteristics are impaired. In addition the pattern is coarsened, and generation of film residues at the time of the developing readily occurs. If there is more than 85 wt % then, since there is little photosensitive component, photocuring does not occur right down to the barrier rib pattern bottom and the pattern formability tends to be impaired.

When this method is employed, it is preferred that the following kind of glass powder be used as the inorganic material.

By adding aluminium oxide, barium oxide, calcium oxide, magnesium oxide, zinc oxide, zirconium oxide or the like, and in particular aluminium oxide, barium oxide or zinc oxide, in the glass powder, it is possible to control the softening point, the coefficient of thermal expansion and the refractive index, but the content thereof is preferably no more than 40 wt % and more preferably no more than 25 wt %.

Now, the glass generally used as an insulator has a refractive index of about 1.5 to 1.9, but where the photosensitive paste method is used, if the average refractive index of the organic component is greatly different from the average refractive index of the glass powder, there is increased reflection/scattering at the interface between the glass component and the organic component, so that a precise pattern is not obtained. The refractive index of the usual organic component is 1.45 to 1.7, so in order to match the refractive indexes of the glass powder and the organic component it is preferred that the average refractive index of the glass powder be in the range from 1.5 to 1.7. Still more preferred is from 1.5 to 1.65.

By using a glass containing in total from 2 to 10 wt % of oxide of an alkali metal, such as sodium oxide, lithium oxide or potassium oxide, not only is it easy to control the softening point and the coefficient of thermal expansion, but also the average refractive index of the glass can be lowered and so it becomes easy to reduce the difference in refractive index in terms of the organic material. If there is less than 2%, control of the softening point becomes difficult. When there is more than 10%, there is a reduction in the luminosity due to vaporization of the alkali metal oxide at the time of discharge. Furthermore, in terms of enhancing the paste stability the amount of alkali metal oxide added is preferably less than 8 wt % and more preferably less than 6 wt %.

From amongst the alkali metals, the use of lithium oxide is particularly preferred in that it is possible to raise the comparative paste stability. Again, where potassium oxide is used there is the advantage that the refractive index can be controlled with the addition of comparatively small amounts.

As a result, it is possible to achieve an average refractive index of from 1.5 to 1.7 with a softening point which allows firing onto a glass substrate, and the reduction of the refractive index difference in terms of the organic component is easy.

A glass containing bismuth oxide is preferred in terms of the softening point and enhancing the water resistance, but a glass containing more than 10 wt % of bismuth oxide usually has a refractive index of 1.6 or above. Hence, by the joint use of bismuth oxide and an alkali metal oxide such as sodium oxide, lithium oxide or potassium oxide, control of the softening point, coefficient of thermal expansion, water resistance and refractive index becomes easy.

With regard to the refractive index measurement for the glass material in the present invention, measurement at the wavelength of the light used for exposure in the photosensitive glass paste method is appropriate in terms of confirming the effect. In particular, measurement by light of wavelength in the range 350–650 nm is preferred. Moreover, refractive index measurement at the i-line (365 nm) or g-line (436 nm) is preferred.

The barrier ribs of the present invention may be coloured black in that this is outstanding from the point of view of raising the contrast. It is possible to produce coloured barrier ribs, following the firing, by the addition of various metal oxides. For example, by including from 1 to 10 wt % of black metal oxide in the photosensitive paste, it is possible to form a black pattern.

As the black metal oxide used in such circumstances, by adding at least one and preferably three or more oxides of Ru, Cr, Fe, Co, Mn and Cu, producing a black colour is possible. In particular, black pattern formation is possible by including from 5 to 20 wt % of Ru and Cu oxide respectively.

Moreover, besides black, by using a paste to which has been added an inorganic pigment giving a red, blue, green or other colour, it is possible to form a pattern of the particular colour. These coloured patterns can be favourably used for plasma display colour filters or the like.

From the point of view of outstanding panel power consumption and discharge life, it is preferred that the dielectric constant of the barrier rib glass material be from 4 to 10 at a frequency of 1 MHz and a temperature of 20° C. In order for the value to be less than 4, considerable silicon oxide of dielectric constant about 3.8 has to be included, so the glass transition point is increased and the firing temperature raised, leading to substrate strain, so this is undesirable. If it is more than 10, power loss is produced due to an increase in the amount of static, so there is an increase in power consumption, which is undesirable.

Moreover, the specific gravity of the barrier ribs in the present invention is preferably from 2 to 3.3. In order to have a value below 2, there has to a considerable amount of alkali metal oxide such as sodium oxide or potassium oxide in the glass material, leading to vaporization during discharge and a lowering of the discharge characteristics, which is undesirable. If it is over 3.3, the display becomes heavy when the picture area is increased and strain is produced in the substrate due to the weight, which is undesirable.

The particle diameter of the glass powder used above is selected taking into account the line width and height of the barrier ribs to be produced, but it is preferred that the 50 vol % particle diameter (average particle diameter $D_{50}$) is from 1 to 6 $\mu$m, the maximum particle diameter size is no more than 30 $\mu$m, and that the specific surface area is from 1.5 to 4 $m^2/g$. More preferably, the 10 vol % particle diameter (average particle diameter $D_{10}$) is from 0.4 to 2 $\mu$m, the 50 vol % particle diameter ($D_{50}$) is from 1.5 to 6 $\mu$m, the 90 vol % particle diameter ($D_{90}$) is from 4 to 15 $\mu$m, the maximum particle diameter size is no more than 25 $\mu$m, and the specific surface area is from 1.5 to 3.5 $m^2/g$. Still more preferred is a $D_{50}$ of 2 to 3.5 $\mu$m, and a specific surface area of 1.5 to 3 $m^2/g$.

Here, $D_{10}$, $D_{50}$ and $D_{90}$ are respectively the particle diameters of 10 vol %, 50 vol % and 90 vol % of the glass powder based on increasing particle size in the glass powder.

If the particle size distribution is smaller than the above, the specific surface area is increased so that there is increased powder aggregation and the dispersibility in the organic component is lowered, so bubbles are readily incorporated. Hence, light scattering is increased, there is thickening of the barrier rib central regions, insufficient curing occurs at the bottom and the desired shape is not obtained. Again, where it is made larger, the bulk density of the powder is lowered and the packability is reduced, and since the amount of photosensitive organic component is insufficient bubbles are readily incorporated, with the result that light scattering is readily brought about.

Thus, there is an optimal region in the particle size distribution, and by using a glass powder with the aforesaid particle size distribution, the packing of the powder is enhanced and even where the powder proportion in the photosensitive paste is increased there is little incorporation of bubbles, and little excess light scattering, so barrier rib pattern formation is made possible. Moreover, since the powder packing ratio is high, the percentage shrinkage on firing is reduced and pattern precision enhanced, so a favourable barrier rib shape is obtained.

The method of measuring the particle diameter is not especially restricted, but using a laser diffraction/scattering method is preferred in that measurement can be conducted simply. For example, the measurement conditions when there is used a model HRA9320-X100 particle size distribution tester made by the Microtrak Co., are as follows.

amount of sample: 1 g dispersion conditions: ultrasonic dispersion in purified water for from 1 to 1.5 minutes; where dispersion is difficult, carried out in 0.2% aqueous sodium hexametaphosphate solution.

refractive index of particles: alters according to the type of glass (lithium type 1.6, bismuth type 1.88)

refractive index of solvent: 1.33 number of measurements: two

In the barrier ribs of the present invention there may be included from 3 to 60 wt % of filler of softening point 550–1200° C. and more preferably 650–800° C. In this way, in the photosensitive paste method, the percentage shrinkage at the time of firing following pattern formation is reduced, pattern formation is facilitated and the shape retentivity at the time of firing is enhanced.

As the filler, a high melting glass powder containing at least 15 wt % of titania, alumina, barium titanate, zirconia or other such ceramic, silicon oxide or aluminium oxide is preferred. As an example, the use of a glass powder with the following composition is preferred.

| | |
|---|---|
| silicon oxide: | 25–50 wt % |
| boron oxide: | 5 to 20 wt % |
| aluminum oxide: | 25 to 50 wt % |
| barium oxide: | 2 to 10 wt % |

When using a high melting point glass powder as a filler, if there is a great difference in refractive index from that of the parent glass material (the low melting point glass), matching with the organic component becomes difficult and pattern formability is impaired.

Hence, where the average refractive index $N_1$ of the low melting glass powder and the average refractive index of the high melting glass powder $N_2$ lie within the following range, refractive index matching with the organic component becomes easy.

$$-0.05 \leqq N_1 - N_2 \leqq 0.05$$

It is also important for reducing light scattering that there be little variation in the refractive index of the inorganic powder. A dispersion in refractive index of ±0.05 (at least 95 vol % of the inorganic powder will lie in the range average refractive index $N_1 \pm 0.05$) is preferred in terms of reducing the light scattering.

The average particle diameter of the filler used is preferably from 1 to 6 μm. Furthermore, using material with a particle size distribution in which $D_{10}$ (10 vol % particle diameter) is from 0.4 to 2 μm, $D_{50}$ (50 vol % particle diameter) is from 1 to 3 μm, $D_{90}$ (90 vol % particle diameter) is from 3 to 8 μm, and the maximum particle diameter size is no more than 10 μm, is preferred in terms of pattern formation.

It is still further preferred that $D_{90}$ is from 3 to 5 μm, and that the maximum particle diameter size is no more than 5 μm. A fine powder in which $D_{90}$ is from 3 to 5 μm is excellent in that it is possible to have low shrinkage on firing and, moreover, barrier ribs of low porosity are produced, so this is preferred. Again, it is possible to keep unevenness in the lengthwise direction at the tops of the barrier ribs to no more than ±2 μm. If there is used powder with a large particle diameter as a filler, then not only is the porosity increased but also the unevenness at the tops of the barrier ribs is increased, and erroneous discharge is brought about, so this is undesirable.

As the organic component contained in the glass paste there can be used cellulose compounds typified by ethyl cellulose, acrylic polymers typified by polyisobutyl methacrylate, and the like. Other examples are polyvinyl alcohol, polyvinyl butyral, methacrylate ester polymers, acrylate ester polymers, acrylate ester/methacrylate ester copolymers, α-methylstyrene polymer, butyl methacrylate resin and the like.

Additionally, in the glass paste it is possible to include various additives in accordance with the requirements, and in cases where it is desired to adjust the viscosity an organic solvent may also be added. As the organic solvent employed at this time, there can be used methyl cellosolve, ethyl cellosolve, butyl cellosolve, methyl ethyl ketone, dioxane, acetone, cyclohexanone, cyclopentanone, isobutyl alcohol, isopropyl alcohol, tetrahydrofuran, dimethylsulphoxide, γ-butyrolactone, bromobenzene, chlorobenzene, dibromobenzene, dichloro-benzene, bromobenzoic acid, chlorobenzoic acid, terpineol and the like, or an organic solvent mixture containing one or more of these may be employed.

Again, in the case where there is used the photosensitive paste method as the method of forming the barrier ribs, the following kinds of organic component are employed.

The organic component will include a photosensitive component selected from at least one type of photo-sensitive monomer, photosensitive oligomer and photo-sensitive polymer and, furthermore, according to the requirements there may also be added binder, photo-polymerization initiator, ultraviolet light absorber, sensitizer, sensitizing auxiliary, polymerization inhibitor, plasticizer, thickener, organic solvent, antioxidant, dispersing agent, organic or inorganic precipitation preventing agent, and the like.

Photosensitive components may comprise those that are rendered insoluble by light and those that are rendered soluble by light, and as examples of those rendered insoluble by light there are (A) those containing functional monomer, oligomer or polymer with one or more unsaturated group or the like in the molecule, (B) those containing a photosensitive compound such as an aromatic diazo compound, aromatic azide compound, organic halogen compound or the like, and (C) so-called diazo resins comprising a condensation product of a diazo amine and formaldehyde, or the like.

As examples of those rendered soluble by light, there are (D) those containing a complex of a diazo compound and inorganic salt or organic acid, or a quinone diazo, and (E) quinone diazos coupled with a suitable polymer binder, for example the naphthoquinone-1,2-diazido-5-sulphonic acid ester of a phenolic or novolak resin.

Any of the above can be employed as the photosensitive component used in the present invention. Those in (A) are preferred as a photosensitive component which can be used simply as a photosensitive paste by mixing with inorganic particles.

As photosensitive monomers there are compounds containing a carbon-carbon unsaturated bond, specific examples of which are methyl acrylate, ethyl acrylate, n-propyl acrylate, isopropyl acrylate, n-butyl acrylate, sec-butyl acrylate, sec-butyl acrylate, isobutyl acrylate, tert-butyl acrylate, n-pentyl acrylate, allyl acrylate, benzyl acrylate, butoxyethyl acrylate, butoxytriethylene glycol acrylate, cyclohexyl acrylate, dicyclopentanyl acrylate, dicyclopentenyl acrylate, 2-ethylhexyl acrylate, glyceryl acrylate, glycidyl acrylate, heptadecafluorodecyl acrylate, 2-hydroxyethyl acrylate, isobornyl acrylate, 2-hydroxypropyl acrylate, isodecyl acrylate, isooctyl acrylate, lauryl acrylate, 2-methoxyethyl acrylate, methoxyethylene glycol acrylate, methoxydiethylene glycol acrylate, octafluoropentyl acrylate, phenoxyethyl acrylate, stearyl acrylate, trifluoroethyl acrylate, allylated cyclohexyl diacrylate, 1,4-butanediol diacrylate, 1,3-butylene glycol diacrylate, ethylene glycol diacrylate, diethylene glycol diacrylate, triethylene glycol diacrylate, polyethylene glycol diacrylate, dipentaerythritol hexaacrylate, dipenta-erythritol monohydroxypentaacrylate, ditrimethylolpropane tetraacrylate, glyceryl diacrylate, methoxylated cyclohexyl diacrylate, neopentyl glycol diacrylate, propylene glycol diacrylate, polypropylene glycol diacrylate, triglycerol diacrylate, trimethylolpropane triacrylate, acrylamide, aminoethyl acrylate, phenyl acrylate, phenoxyethyl acrylate, benzyl acrylate, 1-naphthyl acrylate, 2-naphthyl acrylate, bisphenol A diacrylate, diacrylate of bisphenol A/ethylene oxide addition product, diacrylate of bisphenol A/propylene oxide addition product, thiophenol acrylate, benzylmercaptan acrylate and other such acrylates, or these monomers where from 1 to 5 of the hydrogen atoms on an aromatic ring therein have been substituted by chlorine or bromine atoms, or alternatively styrene, p-methylstyrene, o-methylstyrene, m-methylstyrene, chlorinated styrene, brominated styrene, α-methylstyrene, chlorinated α-methylstyrene, brominated α-methylstyrene, chloromethylstyrene, hydroxymethylstyrene, carboxymethylstyrene, vinylnaphthalene, vinylanthracene, vinylcarbazole, and these same compounds where the acrylate within the molecule is in part or totally converted to methacrylate, γ-methacryloxypropyltrimethoxysilane, 1-vinyl-2-pyrrolidone and the like. In the present invention, there can be used one or more than one of these.

As well as these, the developing properties following exposure can be enhanced by adding an unsaturated acid such as an unsaturated carboxylic acid. Specific examples of the unsaturated carboxylic acid are acrylic acid, methacrylic acid, itaconic acid, crotonic acid, maleic acid, fumaric acid, vinylacetic acid and the anhydrides of these.

The content of such monomer is preferably from 5 to 30 wt % in terms of the sum of the glass powder and photosensitive component. Outside of this range, there is a deterioration in pattern formability, and inadequate hardness following curing arises, so this is undesirable.

As examples of the binder, there are polyvinyl alcohol, polyvinyl butyral, methacrylate ester polymer, acrylate ester polymer, acrylate ester/methacrylate ester copolymer, α-methylstyrene polymer and butyl methacrylate resin.

Again, it is possible to employ oligomer or polymer obtained by the polymerization of at least one of the aforesaid compounds with a carbon-carbon double bond. At the time of the polymerization, it is possible to produce copolymer with other photosensitive monomer, such that the content of the aforesaid photoreactive monomer is at least 10 wt % and more preferably at least 35 wt %.

By the copolymerization of an unsaturated carboxylic acid or other such unsaturated acid as the copolymerized monomer, it is possible to enhance the developing properties following photosensizing. Specific examples of the unsaturated carboxylic acids are acrylic acid, methacrylic acid, itaconic acid, crotonic acid, maleic acid, fumaric acid, vinylacetic acid and the anhydrides thereof.

The acid value (AV) of the polymer or oligomer thus obtained which has carboxyl groups or other such acidic groups as side chains is preferably from 30 to 150, with the range from 70 to 120 being further preferred. If the acid value is less than 30, the solubility of the unexposed regions in terms of the developer is lowered, but when the developer concentration is increased separation occurs right into the exposed regions and a high resolution pattern is not obtained. Again, if the acid value exceeds 150, the allowable range of development is narrowed.

In cases where developability is conferred with monomer such as an unsaturated acid, by having a polymer acid value of below 50 it is possible to suppress gelling due to reaction of the polymer with the glass powder, so this is preferred.

By adding photoreactive groups to the side chains or molecular terminals of the polymers or oligomer described above, they can be used as photosensitive polymers or photosensitive oligomers which possess photosensitivity. Preferred photoreactive groups are those with an ethylenically unsaturated group. As examples of the ethylenically unsaturated group there are the vinyl group, allyl group, acrylic group and methacrylic group.

As a method for the addition of such side chains to oligomers and polymers, there is the method of performing an addition reaction between mercapto groups, amino groups, hydroxyl groups or carboxyl groups in the polymer and an ethylenically unsaturated compound containing a glycidyl group or isocyanate group, or acrylyl chloride, methacrylyl chloride or allyl chloride.

Examples of ethylenically unsaturated compounds containing a glycidyl group are glycidyl acrylate, glycidyl methacrylate, allyl glycidyl ether, glycidyl ethyl acrylate, crotonyl glycidyl ether, crotonic acid glycidyl ether and isocrotonic acid glycidyl ether.

Examples of ethylenically unsaturated compounds containing an isocyanate group are (meth)acryloyliso-cyanate and (meth)acryloylethylisocyanate.

Again, it is preferred that from 0.05 to 1 mole equivalent of the ethylenically unsaturated compound containing a glycidyl group or isocyanate group, or acrylyl chloride, methacrylyl chloride or allyl chloride, be added in terms of the mercapto groups, amino groups, hydroxyl groups or carboxyl groups in the polymer.

The amount of polymer component comprising photosensitive polymer, photosensitive oligomer and binder in the photosensitive glass paste is preferably from 5 to 30 wt % in terms of the sum of the glass powder and photosensitive component, from the point of view of excellent pattern formability and shrinkage following firing. Outside of this range, pattern formation is either impossible or the pattern is thickened, so this is undesirable.

As specific examples of the photopolymerization initiator, there are benzophenone, methyl o-benzoylbenzoate, 4,4-bis(dimethylamino)benzophenone, 4,4-bis(diethylamino)benzophenone, 4,4-dichlorobenzophenone, 4-benzoyl-4-methyldiphenyl ketone, dibenzyl ketone, fluorenone, 2,2-diethoxyacetophenone, 2,2-dimethoxy-2-phenyl-2-phenylacetophenone, 2-hydroxy-2-methylpropiophenone, p-t-butyl-dichloroacetophenone, thioxanthone, 2-methylthioxanthone, 2-chlorothioxanthone, 2-isopropylthioxanthone, diethylhioxanthone, benzyl dimethyl ketanol, benzylmethoxyethylacetal, benzoin, benzoin methyl ether, benzoin butyl ether, anthraquinone, 2-t-butylanthraquinone, 2-amyl-anthraquinone, β-chloroanthraquinone, anthrone, benz-anthrone, dibenzosuberone, methyleneanthrone, 4-azidobenzalacetophenone, 2,6-bis(p-azidobenzylidene)cyclohexanone, 2,6-bis(p-azidobenzylidene)-4-methylcyclohexanone, 2-phenyl-1,2-butadione-2-(o-methoxycarbonyl)-oxime, 1-phenyl-propanedione-2-(o-ethoxycarbonyl)oxime, 1,3-diphenylpropanetrione-2-(o-ethoxycarbonyl)oxime, 1-phenyl-3-ethoxy-propanetrione-2-(o-benzoyl)oxime, Michler's ketone, 2-methyl-[4- (methylthio)phenyl]-2-morpholino-1-propanone, 2-benzyl-2-dimethylamino-1-(4-morpholinophenyl)butanone-1, naphthalenesulphonyl chloride, quinolinesulphonyl chloride, N-phenylthioacridone, 4,4-azobisisobutyronitrile, diphenyl disulphide, benzthiazole disulphide, triphenylphosphine, camphor quinone, carbon tetrabromide, tribromophenylsulphone, benzoin peroxide, and combinations of a photoreducing dye such as Eosine or Methylene Blue and a reducing agent such ascorbic acid or triethanolamine. One, or two or more types of these, can be used in the present invention.

The photopolymerization initiator is added in the range from 0.05 to 20 wt %, more preferably 0.1 to 15 wt %, in terms of the photosensitive component. If the amount of the photoinitiator is too low, then the photo-sensitivity is poor, while when the amount of the photoinitiator is too great there is a fear that the residual proportion of the exposed regions will be too small.

The addition of an ultraviolet light absorbing agent is also effective. By adding a compound with a large ultraviolet light absorption effect, high aspect ratio, high precision and high resolution are obtained. As the ultraviolet light absorbing agent there is preferably employed one comprising an organic dye, in particular an organic dye having a high UV absorption coefficient in the wavelength range 350–450 nm. Specifically, there can be used azo dyes, aminoketone dyes, xanthene dyes, quinoline dyes, or anthraquinone, benzophenone, diphenyl-cyanoacrylate, triazine or p-aminobenzoic acid dyes. Where an organic dye has been added as a light absorbing agent, it does not remain in the insulating film following firing and it is possible to minimize any lowering of the insulating film properties due to the light absorbing agent, so this is preferred. Amongst such dyes, the azo and benzophenone dyes are preferred.

The amount of organic dye added is preferably from 0.05 to 1 part by weight in terms of the glass powder. With less than 0.05 wt %, there is little effect due to the addition of ultraviolet light absorbing agent, while if the amount exceeds 1 wt % then the properties of the insulating film after firing are reduced, so this is undesirable. More preferably, the range is from 0.1 to 0.18 wt %.

An example of the method of adding an ultraviolet light absorbing agent which comprises an organic dye will be provided. A solution is prepared by dissolving the organic dye in an organic solvent, and this solution is mixed-in at the time of the paste preparation. Alternatively, there is also the method of mixing fine glass particles into said organic dye solution and then drying. By this method, the individual surfaces of the fine glass particles are coated with a film of the organic dye, and it is possible to produce so-called encapsulated fine particles.

In the present invention, metals such as Ca, Fe, Mn, Co and Mg, and the oxides thereof, contained in the inorganic fine particles, may react with the photo-sensitive component contained in the paste, bringing about gelling within a short time and making coating impossible. In order to prevent such reaction, it is preferred that a stabilizer be added and the gelling prevented. Triazole compounds are preferably employed as the stabilizer used. Benzotriazole derivatives are preferably used as the triazole compounds. Of these, benzotriazole per se acts particularly effectively. To give an example of the surface treatment of fine glass particles by means of benzotriazole used in the present invention, a specified amount of benzotriazole in terms of the inorganic fine particles is dissolved in an organic solvent such as methyl acetate, ethyl acetate, ethyl alcohol or methyl alcohol, after which the fine particles are immersed in the solution for 1 to 24 hours so that they can be thoroughly soaked. Following the immersion, the solvent is evaporated, preferably at 20–30° C. by natural drying, and triazole-treated fine particles produced. The proportion of stabilizer used (stabilizer/inorganic fine particles) is preferably from 0.05 to 5 wt %.

A sensitizer is added to enhance the sensitivity. Specific examples of sensitizers are 2,4-diethylthio-xanthone, isopropylthioxanthone, 2,3-bis(4-diethylaminobenzal) cyclopentanone, 2,6-bis(4-dimethylaminobenzal) cyclohexanone, 2,6-bis(4-dimethylaminobenzal)-4-methylcyclohexanone, Michler's ketone, 4,4-bis (diethylamino)benzophenone, 4,4-bis(dimethylamino) chalcone, 4,4-bis(diethylamino)chalcone, p-dimethylaminocinnamylideneindanone, p-dimethylaminobenzylideneindanone, 2-(p-dimethylaminophenylvinylene)isonaphthothiazole, 1,3-bis (4-dimethylaminobenzal)acetone, 1,3-carbonyl-bis(4-diethylaminobenzal)acetone, 3,3-carbonyl-bis(7-diethylaminocoumarin), N-phenyl-N-ethylethanolamine, N-phenylethanolamine, N-tolyldiethanolamine, N-phenylethanolamine, isoamyl dimethylaminobenzoate, isoamyl diethylaminobenzoate, 3-phenyl-5-benzoylthiotetrazole and 1-phenyl-5-ethoxycarbonylthiotetrazole. In the present invention, one, or two or more types of these, can be used. Now, amongst the sensitizers there are those which can also be used as photopolymerization initiators. In the case where a sensitizer is added to the photosensitive paste of the present invention, the amount added is normally from 0.05 to 10 wt %, and more preferably from 0.1 to 10 wt %, in terms of the photosensitive component. If the amount of photosensitizer is too low, then no effect is shown in terms of enhancing the photosensitivity, while if the amount of the sensitizer is too great then there is a fear that the residual proportion of the exposed regions will be too small.

Again, where there is used a sensitizer which absorbs at the light exposure wavelength, in the vicinity of the absorption wavelength the refractive index becomes extremely high, so by the addition of a large amount of sensitizer it is possible to enhance the refractive index of the organic component. The amount of sensitizer which can be added in such a case is from 3 to 10 wt %.

A polymerization inhibitor is added to enhance the thermal stability at the time of storage. Specific examples of the polymerization inhibitor are hydroquinone, monoesters of hydroquinone, N-nitroso-diphenylamine, phenothiazine, p-t-butylcatechol, N-phenylnaphthylamine, 2,6-di-t-butyl-p-methylphenol, chloranil, pyrogallol and the like.

Again, the photocuring reaction threshold value is raised by the addition, and pattern line width reduction and the thickening of pattern tops in terms of gaps are eliminated.

The amount added is normally from 0.01 to 1 wt % in the photosensitive paste. If it is less than 0.01 wt % then no effect tends to be apparent due to the addition, while if more than 1 wt % is added then the sensitivity is lowered, so it is necessary to increase the exposure to form the pattern.

As specific examples of the plasticizer, there are dibutyl phthalate, dioctyl phthalate, polyethylene glycol and glycerol.

An antioxidant is added to prevent oxidation of the acrylic copolymer during storage. As specific examples of the antioxidant, there are 2,6-di-t-butyl-p-cresol, butylated hydroxyanisole, 2,6-di-t-4-ethylphenol, 2,2-methylene-bis-(4-methyl-6-t-butylphenol), 2,2-methylene-bis-(4-ethyl-6-t-butylphenol), 4,4-bis-(3-methyl-6-t-butylphenol), 1,1,3-tris-(2-methyl-6-t-butylphenol), 1,1,3-tris-(2-methyl-4-hydroxy-t-butylphenyl)butane, bis[3,3-bis-(4-hydroxy-3-t-butylphenyl)butyric acid]glycol ester, dilaurylthiodipropionate and triphenyl phosphate. In the case of the addition of an antioxidant, the amount added is normally from 0.01 to 1 wt % in the paste.

In the photosensitive paste of the present invention, there may be added an organic solvent. As examples of the organic solvent used at this time, there are methyl cellosolve, ethyl cellosolve, butyl cellosolve, methyl ethyl ketone, dioxane, acetone, cyclohexanone, cyclopentanone, isobutyl alcohol, isopropyl alcohol, tetrahydrofuran, dimethylsulphoxide, γ-butyrolactone, bromobenzene, chlorobenzene, dibromobenzene, dichloro-benzene, bromobenzoic acid, chlorobenzoic acid and the like, and organic solvent mixtures containing one or more of these may be employed.

The refractive index of the organic component is the refractive index of the organic component in the paste at the point when the photosensitive component is sensitized by exposure. That is to say, in the case where the paste is applied and, following a drying process, exposure then carried out, it refers to the refractive index of the organic component in the paste following the drying process. Thus, for example, there is the method whereby the paste is applied onto a glass substrate, after which it is dried for 1 to 30 minutes at 50 to 100° C. and then the refractive index measured.

With regard to the measurement of the refractive index in the present invention, the generally-used ellipsometric method or the V block method are preferred, and carrying out measurement at the wavelength of the light used for exposure is appropriate for the purpose of confirming the effect. In particular, it is preferred that measurement be carried out with light of wavelength in the range 350–650 nm. Furthermore, refractive index measurement at the i-line (365 nm) or g-line (436 nm) is preferred.

Again, in order to measure the refractive index following polymerization of the organic component by light irradiation, measurement can be carried out by irradiating just the organic component with light identical to that in the case of the light irradiation of the paste.

The photosensitive paste is normally produced by preparing the various components such as the inorganic fine particles, ultraviolet light absorbing agent, photosensitive polymer, photosensitive monomer, photo-polymerization initiator, glass frit and solvent so as to give the specified composition, after which uniform mixing and dispersing is carried out with a triple-roll mill or kneader.

The viscosity of the paste can be suitably adjusted based on the added proportions of the inorganic fine particles, thickener, organic solvent, plasticizer, precipitation preventing agent and the like, and its range is 2000 to 200,000 cps (centipoise). For example, in the case where application on the glass substrate is carried out by the spin coater method, from 200 to 5000 cps is preferred. In order to obtain a film thickness of 10–20 $\mu$m by a single application by the screen printing method, from 10,000 to 100,000 cps is preferred.

Next, explanation is given of an example of pattern processing using the photosensitive paste, but the invention is not to be restricted by this.

The photosensitive paste is applied over the entire face or parts of a glass substrate, ceramic substrate or polymer film. The method of application employed can be by means of screen printing, a bar coater, roller coater, die coater, blade coater or other such method. The application thickness can be adjusted by selection of the number of applications, the mesh of the screen and the viscosity of the paste.

Here, in the case where the paste is applied to a substrate, it is possible to carry out surface treatment of the substrate in order to increase the adhesion between substrate and applied film. The surface treatment liquid is a silane coupling agent such as, for example, vinyltrichlorosilane, vinyltrimethoxysilane, vinyltriethoxysilane, tris-(2-methoxyethoxy)vinylsilane, γ-glycidoxypropyltrimethoxysilane, γ-(methacryloxypropyl)trimethoxysilane, γ(2-aminoethyl)aminopropyltrimethoxysilane, γ-chloropropyltrimethoxysilane, γ-mercaptopropyltrimethoxysilane or γ-aminopropyltriethoxysilane, or an organic metal such as, for example, organic titanium, organic aluminium or organic zirconium. The silane coupling agent or organic metal is used diluted to a concentration of 0.1 to 5% with an organic solvent such as ethylene glycol monomethyl ether, ethylene glycol monoethyl ether, methyl alcohol, ethyl alcohol, propyl alcohol or butyl alcohol. The surface treatment can be conducted by applying this surface treatment liquid uniformly onto the substrate with a spin coater or the like, and drying for 10 to 60 minutes at 80–140° C.

Again, in the case where application is made to a film, either drying is carried out on the film after which the following exposure process is carried out, or it is affixed to a glass or ceramic substrate after which the exposure process is carried out.

Following application, light exposure is carried out using an exposure device. Just as is practised in ordinary photolithography, the general method of exposure is mask exposure using a photo mask. The mask selected may be either a negative or positive type, depending on the type of photosensitive organic component. There may also be used a direct imaging method with red or blue laser light, or the like, without employing a photo mask.

It is possible to use a stepper exposure system or a proximity exposure system as the exposure device. Moreover, when carrying out exposure of a large area, following the application of the photosensitive paste on the substrate such as a glass substrate, by conducting said exposure while moving it is possible to expose a large area with an exposure means of small exposure area.

As examples of the active light source employed at this time, there are visible light rays, near ultraviolet rays, ultraviolet rays, an electron beam, X-rays or laser light but, of these, ultraviolet rays are preferred, and as the source thereof there can be used a low pressure mercury lamp, high pressure mercury lamp, ultrahigh pressure mercury lamp, halogen lamp or sterilizing lamp. Of these, an ultrahigh pressure mercury lamp is ideal. The exposure conditions will vary depending on the application thickness but, using an ultrahigh pressure mercury lamp of output from 3 to 50 mW/cm$^2$, exposure is conducted for from 20 seconds to 30 minutes.

Following the exposure, developing is carried out utilizing the differences of solubility in the developer liquid of the exposed and unexposed regions following exposure, and this is performed by an immersion method, shower method, spray method or brush method.

The developer liquid used can be an organic solvent in which the organic component in the photosensitive paste can dissolve. Moreover, water may also be added to said organic solvent within a range such that the dissolving power of the latter is not lost. In the case where a compound with acidic groups such as carboxyl groups is present in the photosensitive paste, the developing can be conducted with an aqueous alkali solution. An aqueous solution of an alkali metal such as sodium hydroxide, sodium carbonate or calcium hydroxide can be used as this aqueous alkali solution, but by using an aqueous solution of organic alkali the alkali component is more readily eliminated at the time of firing, so this is preferred.

Amine compounds can be employed as the organic alkali. Specific examples are tetramethylammonium hydroxide, trimethylbenzylammonium hydroxide, monoethanolamine and diethanolamine. The concentration of the aqueous alkali solution is normally from 0.01 to 10 wt % and more preferably from 0.1 to 5 wt %. If the alkali concentration is too low then the soluble regions cannot be removed, while if the alkali concentration is too high then there is a fear of pattern areas separating away and of erosion of the non-soluble regions. Again, it is preferred, in terms of process control, that the temperature when developing is carried out be 20–50° C.

Next, firing is carried out in a firing oven. The firing atmosphere and temperature will differ according to the type of paste and substrate, but the firing will be conducted in air, nitrogen, hydrogen or the like. A batch type firing oven or a belt type continuous firing oven can be used as the firing oven.

In the case of pattern processing on a glass substrate, the firing is carried out by heating at a rate of 200–400° C. per hour and holding for 10 to 60 minutes at a temperature of 540–610° C. Now, the firing temperature is determined by the glass powder used but it is preferred that the firing be carried out at a suitable temperature such that the shape following pattern formation is not destroyed and such that the powder form of the glass does not remain.

At a lower than suitable temperature, porosity and unevenness at the tops of barrier ribs are increased, so that the discharge life is shortened and erroneous discharge tends to occur, so this is undesirable.

Again, at a higher than suitable temperature, the shape at the time of pattern formation collapses, with the tops of the barrier ribs being rounded and the height being markedly lowered, so that the desired height is not obtained. Hence, this is undesirable.

Again, within the aforesaid application, exposure, developing and firing processes, there may be introduced a heating process at 50–300° C. for the purposes of drying or preliminary reaction.

Below, the present invention is explained in specific terms using examples. However, the invention is not to be restricted by these. Now, unless otherwise stated, the concentrations (%) in the examples and comparative examples are in percentages by weight.

| | |
|---|---|
| Glass (1); | |
| Composition: | $Li_2O$ 7%, $SiO_2$ 22%, $B_2O_3$ 32%, BaO 4%, $Al_2O_3$ 22%, ZnO 2%, MgO 6%, CaO 4% |
| Thermal Properties: | glass transition point 491° C., softening point 528° C., coef. of thermal expansion $74 \times 10^{-7}$/K |
| Particle diameter: | $D_{10}$ 0.9 μm<br>$D_{50}$ 2.6 μm<br>$D_{90}$ 7.5 μm<br>maximum particle diameter 22.0 μm |
| Specific surface area: | 1.92 $m^2$/g |
| Refractive index: | 1.59 (g-line 436 nm) |
| Specific gravity: | 2.54 |
| Glass (2); | |
| Composition: | $Bi_2O_3$ 38%, $SiO_2$ 7%, $B_2O_3$ 19%, BaO 12%, $Al_2O_3$ 4%, ZnO 20% |
| Thermal Properties: | glass transition point 475° C., softening point 515° C., coef. of thermal expansion $75 \times 10^{-7}$/K |
| Particle diameter: | $D_{10}$ 0.9 μm<br>$D_{50}$ 2.5 μm<br>$D_{90}$ 3.9 μm<br>maximum particle diameter 6.5 μm |

(White Filler Powder)

Filler; $TiO_2$, specific gravity 4.61

(Polymer)

Polymer (1); A 40% γ-butyrolactone solution of photosensitive polymer of weight average molecular weight 43,000 and acid value 95 obtained by addition reaction between the carboxyl groups in a copolymer comprising 40% methacrylic acid (MAA), 30% methyl methacrylate (MMA) and 30% styrene (St) and 0.4 equivalents of glycidyl methacrylate (GMA)

Polymer (2); A solution of ethyl cellulose/terpineol=6/94 (weight ratio)

(Monomer)

Monomer (1); $X_2—N—CH(CH_3)—CH_2—(O—CH_2—CH(CH_3))_n—N—X_2$

X: $—CH_2—CH(OH)—CH_2O—CO—C(CH_3)=CH_2$ n=2–10

Monomer (2); trimethyolpropane triacrylate.modified PO (Photopolymerization initiator)

IC-369; Irgacure-369 (a Ciba Geigy product)
2-benzyl-2-dimethylamino-1-(4-morpholinophenyl)-butanone-1

IC-907; Irgacure-907 (a Ciba Geigy product)
2-methyl-1-(4-(methylthio)phenyl-2-morpholinopropanone (Sensitizer)
DETX-S; 2,4-diethylthioxanthone (Sensitizing auxiliary)
EPA; ethyl p-dimethylaminobenzoate (Plasticizer)
DBP; dibutyl phthalate (DBP)

(Thickener)
SiO; 2-(2-butoxyethoxy)ethyl acetate 15% solution of $SiO_2$ (Organic dye)
Sudan; azo type organic dye, chemical formula $C_{24}H_{20}N_4O$, molecular weight 380.45

(Solvent)
γ-butyrolactone
terpineol (Dispersing agent)
Nopco Sperse 092 (made by Sun Nopco)

(Stabilizer)
1,2,3-benzotriazole

EXAMPLE 1

Firstly, a photosensitive paste for the barrier ribs was prepared. There was weighed out a proportion of 0.08 part by weight of the organic dye per 100 parts by weight of glass powder (glass (1)). The Sudan dye was dissolved in acetone, then dispersing agent added and uniform stirring carried out with a homogenizer. The glass powder was added to this solution and, following uniform dispersion and mixing, drying was carried out and the acetone evaporated off at a temperature of 100° C. using a rotary evaporator. In this way there was produced a powder comprising glass powder the surface of which was uniformly coated with a film of organic dye.

Polymer (1), monomer (1), photopolymerization initiator (IC-369), sensitizer, plasticizer and solvent were mixed together at a weight ratio of 37.5:15:4.8:4.8:2:7.5 and uniformly dissolved. Subsequently, this solution was filtered using a 400 mesh filter, and an organic vehicle obtained.

The glass powder and the organic vehicle were added together to give a weight ratio of glass powder:organic vehicle=70:71.6, then mixed and dispersed using a triple roll mill to prepare the photosensitive paste for the barrier ribs. The refractive index of the organic component was 1.59 and the refractive index of the glass powder was 1.59.

Next, in the same way, a paste for the dielectric layer was prepared at a weight ratio of glass (2):filler:polymer (2)= 55:10:35. By screen printing using a 325 mesh screen, this dielectric paste was uniformly applied onto a 13 inch size PD-200 glass substrate made by Asahi Glass on which had previously been formed electrodes of pitch 140 μm, line width 60 μm, and thickness 4 μm. Subsequently, drying was carried out for 40 minutes at 80° C., then preliminary firing conducted at 550° C. and a dielectric layer of thickness 10 μm formed. By screen printing using a 325 mesh screen, the aforesaid barrier rib paste was then uniformly applied onto this dielectric layer and an applied film obtained. In order to avoid the occurrence of pin holes and the like in the applied film, application and drying were repeated a number of times and adjustment of the film thickness thereby carried out. The printing matrix of the screen printing plate used was designed to be smaller than the length of the barrier rib pattern in the lengthwise direction. Intermediate drying was carried out for 10 minutes at 80° C., and the drying following the formation of the applied film was carried out for 1 hour at 80° C. The applied film thickness following the drying was 150 μm. At the applied film ends there were formed inclined faces of length 2000 μm.

Next, ultraviolet irradiation was performed from the upper face with an ultrahigh-pressure mercury lamp of output 50 mJ/$cm^2$ through a 140 μm pitch stripe-shaped negative chromium mask. The exposure level was 1.0 J/$cm^2$.

At this time, the chromium mask used had a barrier rib pattern length greater than the length of the aforesaid applied film in the barrier rib lengthwise direction.

Then, development was carried out by the application with a shower for 170 seconds of an aqueous 0.2 wt % solution of mono-ethanolamine maintained at 35° C., after which washing was performed with water using a shower spray. In this way, regions which had not been photo-cured were eliminated and a stripe-shaped barrier rib pattern was formed on the glass substrate.

The glass substrate on which the barrier rib pattern had been formed in this way was fired for 15 minutes at 570° C. in air, and the barrier ribs formed. The cross-sectional shape of the barrier rib pattern ends were observed before and after firing with a scanning electron microscope (S-2400 made by Hitachi). The evaluation results are shown in Table 1. In cases where there was no swelling upwards or springing up, this was denoted by O, while in cases where there was swelling or springing up, the details and the numerical amounts thereof are shown.

As a result, X was 2 mm and Y was 100 $\mu$m, so X/Y=20 and this was within the range of the present invention. Moreover, the barrier ribs were good, with no springing up or swelling of the ends.

Using a screen printing method, phosphor pastes which emitted red, blue or green light were applied between the barrier ribs formed in this way, and these then fired (at 500° C. for 30 minutes) and phosphor layers formed on the side faces and bottom regions of these barrier ribs, to complete the rear plate.

Next, the front plate was produced by the following process. Firstly, after forming ITO by the sputtering method on a glass substrate identical to the rear plate, a resist was applied and, following exposure to the desired pattern and development, an etching treatment was conducted and transparent electrodes of fired thickness 0.1 $\mu$m and line thickness 200 $\mu$m formed. Again, by the photolithography method using a photosensitive silver paste comprising black silver powder, bus electrodes of thickness after firing 10 $\mu$m were formed. The electrodes were produced at a pitch of 140 $\mu$m and line width 60 $\mu$m.

Furthermore, 20 $\mu$m of transparent dielectric paste was applied onto the front plate on which the electrodes had been formed and firing performed by maintaining for 20 minutes at 430° C. Next, the front plate was completed by forming a MgO film of thickness 0.5 $\mu$m using an electron beam vapour deposition device so as to uniformly cover the transparent electrodes, black electrodes and dielectric layer formed.

After the front plate thus obtained and the aforesaid rear plate were stuck together and sealed, the discharge gas was introduced and a driving circuit connected, to produce the plasma display. By the application of voltage to this panel, display was effected. The evaluation result is shown in Table 1. Where a uniform display was obtained across the entire face, this was denoted by O, while in the case where problems such as erroneous discharge occurred, the details are noted in the table. As shown in Table 1, in this example a uniform display was obtained across the entire face.

EXAMPLE 2

A dielectric layer paste was applied onto a glass substrate in the same way as in Example 1, except that the dielectric layer paste was a photosensitive paste obtained by mixing together glass (2), filler, polymer (2) and monomer (2) at a weight ratio of 22.5:2.2:10:10:0.3:1.6 respectively. The thickness after drying was 15 $\mu$m. Instead of carrying out preliminary firing, exposure to ultraviolet rays was carried out from the upper face with an ultrahigh-pressure mercury lamp of output 50 mJ/cm$^2$, at an exposure level of 1 J/cm$^2$. Thereafter, a plasma display was produced in the same way as in Example 1. The dielectric layer was fired at the same time as the firing of the barrier rib pattern, Evaluation was conducted in the same way as in Example 1. The results are shown in Table 1.

EXAMPLE 3

The same procedure was carried out as in Example 1 except that, when applying the barrier rib photosensitive paste onto the substrate by screen printing, the printing was carried out at a thickness of 50 $\mu$m with a screen printing plate of area greater than the length of the photo-mask barrier rib pattern length, and then printing was carried out at a thickness of 100 $\mu$m using a screen printing plate of printing area smaller than the photo-mask barrier rib pattern length in the same way as in Example 1.

Figure 14:
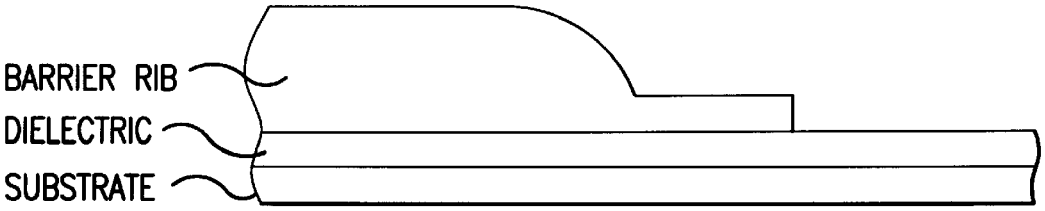
FIG. 14 is a cross-sectional view of the barrier rib pattern with an inclined face formed at the end of the applied film in Example 3.

When pattern formation was carried out, the ends of the barrier rib lower layer portion of thickness 50 $\mu$m formed a right angle shape, and the ends of the barrier rib upper layer portion of thickness 100 $\mu$m were inclined and had the shape shown in FIG. 14.

When firing was carried out in the same way as in Example 1, the ends of the lower layer portion (which had a height of 33 $\mu$m after firing) produced a 10 $\mu$m swelling but the ends of the upper layer portion (which had a height of 67 $\mu$m after firing) could be formed without any swelling. Since, the upper layer portion was 67 $\mu$m, the swelling of the lower layer portion did not exceed the upper layer portion, and the barrier ribs as a whole could be formed without problems. Thereafter, the plasma display was produced and evaluated in the same way as in Example 1. The results are shown in Table 1.

EXAMPLE 4

The formation of the barrier rib pattern was carried out in the same way as in Example 1 except that when applying the barrier rib paste on the substrate a slit die coater was used, with application being carried out at a thickness prior to drying of 250 $\mu$m and, before drying, air was jetted using a nozzle of internal diameter 0.4 mm to form an inclined face at the ends of the applied film. The air pressure was 2.5 kgf.cm$^2$ and the jetting was at an angle of inclination of 45° from the perpendicular to the substrate. Thereafter, the plasma display was produced and evaluated in the same way as in Example 1. The results are shown in Table 1.

EXAMPLE 5

A plasma display was produced and evaluated in the same way as in Example 4 except that when forming the inclined face at the ends of the applied film the pressure of the air jetted from the nozzle was made 0.5 kgf/cm$^2$. The results are shown in Table 1.

EXAMPLE 6

A plasma display was produced and evaluated in the same way as in Example 4 except that, after the application of the barrier rib paste onto the substrate, drying was carried out for 5 minutes at 80° C. and the inclined faces were formed at the ends of the applied film by the jetting, from a nozzle of internal diameter 1.5 mm, of a solvent comprising ethyl cellulose/terpineol=1/99 (by weight) at a Jetting pressure of 1.0 kg/cm$^2$. The results are shown in Table 1.

EXAMPLE 7

A plasma display was produced and evaluated in the same way as in Example 4 except that, when forming the inclined face at the ends of the applied film, the jetting was carried out using a slit of spacing 0.4 mm. The results are shown in Table 1.

EXAMPLE 8

A plasma display was produced and evaluated in the same way as in Example 4 except that when forming the inclined face at the ends of the applied film the applied film was dried for 1 hour at 80° C., after which the ends of the applied film were cut away with a knife to produce the inclined faces. The size of the blade tip of the cutting tool was $\phi$=30° and the cutting tool was arranged to cover the substrate such that the blade was inclined at an angle $\Theta$=45°. 15 $\mu$m per time was cut away at a rate of 5 m/s. This procedure was repeated 5 times and 75 $\mu$m was cut away from the upper portion of the barrier ribs. The results are shown in Table 1.

EXAMPLE 9

Firstly, on an aluminium substrate there was formed a stripe-shaped barrier rib prototype of pitch 200 $\mu$m, line width 30 $\mu$m and height 200 $\mu$m, using a grinding device. Said barrier rib prototype was filled with silicone resin and there was formed a silicone mould (size 300 mm square) in which were formed grooves of pitch 200 $\mu$m, line width 30 $\mu$m and height 200 $\mu$m, and this was employed as the barrier rib mould. By forming inclined regions at the ends of the barrier rib prototype above, there were produced inclined regions over a 3 mm length of the ends of the said barrier rib mould made of silicone resin.

Next, a barrier rib paste of viscosity 9500 cps was produced by adding together 800 g of glass powder (1), 200 g of polymer (2), 50 g of plasticizer and 250 g of terpineol, and mixing and dispersing with a triple roll mill.

Using a doctor blade coater the aforesaid silicone mould was filled with this barrier rib paste, after which it was transferred onto a 400 mm square glass substrate and, by peeling away the silicone mould, the barrier rib pattern was formed. Next, the glass substrate on which was formed the barrier rib pattern was fired under the same firing conditions as in Example 1 and the barrier ribs formed.

Subsequently, a plasma display was produced and evaluated in the same way as in Example 1. The results are shown in Table 1.

EXAMPLE 10

Firstly, by an etching method, stripe-shaped grooves of pitch 200 $\mu$m, line width 30 $\mu$m and height 200 $\mu$m were formed in a copper plate of thickness 1 mm, to produce a barrier rib mould. The etching was carried out in such a way that inclined portions were formed at the ends of the groves at the time of etching.

Next, a barrier rib paste of viscosity 8500 cps was produced by adding together 800 g of glass powder (2), 150 g of polymer (2), 50 g of plasticizer, 100 g of monomer (2), 10 g of polymerization initiator (benzoyl oxide) and 250 g of solvent, and mixing and dispersing with a triple roll mill.

Using a doctor blade coater the aforesaid barrier rib mould was filled with this barrier rib paste, after which it was pressed onto a 400 mm square glass substrate and heated for 30 minutes at 100° C. Next, by peeling away the barrier rib mould, the barrier rib pattern was formed, and the glass substrate on which was formed the barrier rib pattern was fired under the same firing conditions as in Example 1 and the barrier ribs formed.

Subsequently, a plasma display was produced and evaluated in the same way as in Example 1. The results are shown in Table 1.

EXAMPLE 11

By an etching method, stripe-shaped grooves of pitch 200 $\mu$m, line width 30 $\mu$m and height 200 $\mu$m were formed in a copper plate of thickness 1 mm, to produce a barrier rib mould. The etching was carried out in such a way that inclined portions of angle 10° were formed at the ends of the groves at the time of etching.

Barrier rib paste identical to that in Example 10 was applied onto a substrate by the same procedure as in Example 4, and prior to drying the barrier rib mould was pressed against the applied film of barrier rib paste on the glass substrate and heating performed to 80° C. while applying pressure. Next, by peeling away the barrier rib mould the barrier rib pattern was formed, and the glass substrate on which the barrier rib pattern had been formed was fired under the same firing conditions as in Example 1 to form the barrier ribs.

Subsequently, a plasma display was produced and evaluated in the same way as in Example 1. The results are shown in Table 1.

EXAMPLE 12

A plasma display was produced and evaluated in the same way as in Example 1 except that, after applying and drying the barrier rib photosensitive paste in Example 1, there was formed inclined faces by rubbing the end of the applied film of barrier rib photosensitive paste with a cloth containing solvent. The results are shown in Table 1.

COMPARATIVE EXAMPLE 1

Formation of the barrier rib pattern was carried out in the same way as in Example 8 except that the angle $\phi$ of the knife used was made 80° and the length of the inclined face at the ends of the applied layer was made 35 $\mu$m.

The applied film of this paste shrunk to 63% due to firing and so, where firing could be carried out without swelling, after firing X=35 $\mu$m and Y=100 $\mu$m, and it had a form in which X/Y=0.35.

As a result of firing in the same way as in Example 1, 80 $\mu$m springing up was produced at the barrier rib end regions. Subsequently, a plasma display was produced and evaluated in the same way as in Example 1. The results are shown in Table 1. Within a range of width about 10 mm around the display face, cross talk was produced.

COMPARATIVE EXAMPLE 2

Formation of a barrier rib pattern was carried out in the same way as in Example 1 except that there was used a chromium mask smaller than the barrier rib lengthwise direction length of the aforesaid applied film. The ends of the barrier rib pattern were vertical and there was no inclined regions at all.

Figure 5:
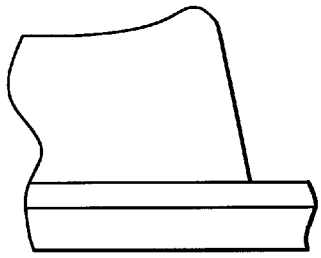
FIG. 5 is a side view showing the form of the swelling.

As a result of firing in the same way as in Example 1, a 20 $\mu$m swelling was produced at the barrier rib end regions. The shape of the barrier rib end regions obtained is shown in FIG. 5. Subsequently, a plasma display was produced and evaluated in the same way as in Example 1. The results are shown in Table 1. Within a range of width about 10 mm around the display face, cross talk was produced.

TABLE 1-1

| | Results | | | | |
|---|---|---|---|---|---|
| | Example 1 | Example 2 | Example 3 | Example 4 | Example 5 |
| Prior to firing: | | | | | |
| X' (μm) | 2000 | 3000 | 2000 | 2000 | 2000 |
| Y' (μm) | 150 | 150 | 100 | 120 | 60 |
| applied film thickness (μm) | 150 | 150 | 150 | 150 | 150 |
| Y'/applied film thickness (μm) | 1 | 1 | 0.67 | 0.53 | 0.4 |
| After to firing: | | | | | |
| X (μm) | 2000 | 3000 | 2000 | 2000 | 2000 |
| Y (μm) | 100 | 100 | 67 | 80 | 40 |
| X/Y | 20 | 30 | 29.9 | 25 | 50 |
| maximum angle (°) | 60 | 55 | 55 | 2.3 | 1.1 |
| State of barrier rib ends | ○ | ○ | ○ | ○ | ○ |
| Height of springing up (μm) (height of swelling) | 0 | 0 | 0 | 0 | 0 |
| Discharge results | ○ | ○ | ○ | ○ | ○ |

TABLE 1-2

| | Results | | | | |
|---|---|---|---|---|---|
| | Example 6 | Example 7 | Example 8 | Example 9 | Example 10 |
| Prior to firing: | | | | | |
| X' (μm) | 4000 | 500 | 130 | 2400 | 2000 |
| Y' (μm) | 75 | 150 | 75 | 200 | 200 |
| applied film thickness (μm) | 150 | 150 | 150 | 200 | 200 |
| Y'/applied film thickness (μm) | 0.5 | 1 | 0.5 | 1 | 1 |
| After to firing: | | | | | |
| X (μm) | 4000 | 500 | 130 | 2400 | 2000 |
| Y (μm) | 50 | 100 | 50 | 120 | 100 |
| X/Y | 80 | 5 | 2.6 | 20 | 20 |
| maximum angle (°) | 0.7 | 11.3 | 30 | 2.9 | 2.9 |
| State of barrier rib ends | ○ | ○ | ○ | ○ | ○ |
| Height of springing up (μm) (height of swelling) | 0 | 0 | 0 | 0 | 0 |
| Discharge results | ○ | ○ | ○ | ○ | ○ |

TABLE 1-3

| | Results | | | |
|---|---|---|---|---|
| | Example 11 | Example 12 | Comparative Example 1 | Comparative Example 2 |
| Prior to firing: | | | | |
| X' (μm) | 570 | 5000 | 35 | 0 |
| Y' (μm) | 200 | 150 | 150 | — |
| applied film thickness (μm) | 200 | 150 | 150 | 150 |
| Y'/applied film thickness (μm) | 1 | 1 | 1 | — |
| After to firing: | | | | |
| X (μm) | 570 | 5000 | NM | NM |
| Y (μm) | 100 | 100 | NM | NM |
| X/Y | 5.7 | 50 | NM | NM |

TABLE 1-3-continued

| | Results | | | |
|---|---|---|---|---|
| | Example 11 | Example 12 | Comparative Example 1 | Comparative Example 2 |
| maximum angle (°) | 10 | 1.1 | 80 | NM |
| State of barrier rib ends | ○ | ○ | springs up | swells upwards |
| Height of springing up (μm) (height of swelling) | 0 | 0 | 80 | 20 |
| Discharge results | ○ | ○ | cross-talk at ends | cross-talk at ends |

NM = impossible to measure

Industrial Utilization Potential

By employing the shape of barrier rib end regions of the present invention, there is obtained a plasma display in which there is no springing up or swelling upwards of the end regions. Hence, no erroneous discharge is produced at the end regions and it is possible to offer a plasma display in which uniform display is possible over the entire face. The plasma display of the present invention can be used for large size televisions and computer monitors.

What is claimed is:

1. A plasma display in which a dielectric layer and stripe-shaped barrier ribs are formed on a substrate, said plasma display being characterized in that there are inclined regions at the lengthwise direction ends of said barrier ribs and, furthermore, the height (Y) of the inclined regions and the length (X) of the base of the inclined regions are within the following range $$0.5 \leqq X/Y \leqq 100.$$

2. A plasma display according to claim 1 which is characterized in that the length (X) of the base of the inclined regions is from 0.05 to 10 mm.

3. A plasma display according to claim 1 which is characterized in that the angle of inclination of the inclined regions is from 0.5 to 60°.

4. A method of manufacturing a plasma display in which a dielectric layer and stripe-shaped barrier ribs are formed on a substrate, said method of manufacturing a plasma display being characterized in that stripe-shaped barrier ribs having inclined regions at the lengthwise direction ends of the barrier ribs and, furthermore, where the height (Y) of said inclined regions and the length (X) of the base of the inclined regions are within the range shown below are formed via a process in which a pattern of stripe-shaped barrier ribs having inclined regions at the ends is formed on a substrate using a barrier rib paste comprising inorganic material and organic component, and a process in which said barrier rib pattern is fired $$0.5 \leqq X/Y \leqq 100.$$

5. A method of manufacturing a plasma display according to claim 4 in which the stripe-shaped barrier ribs are formed via a process in which an applied film is formed by applying a barrier rib paste onto a substrate in such a way that there is an inclined face at the ends, a process in which there is formed a stripe-shaped barrier rib pattern with the inclined faces of the applied film forming the lengthwise direction ends, and a process in which said barrier rib pattern is fired.

6. A method of manufacturing a plasma display according to claim 4 in which the stripe-shaped barrier ribs are formed via a process in which an applied film is formed by applying a barrier rib paste onto a substrate, a process in which said applied film is processed to form inclined faces, a process in which there is formed a stripe-shaped barrier rib pattern with the inclined faces of said applied film forming the lengthwise direction ends, and a process in which said barrier rib pattern is fired.

7. A method of manufacturing a plasma display according to claim 6 in which the process for forming the inclined faces by the processing of the applied film is carried out by spraying a fluid on the applied film.

8. A method of manufacturing a plasma display according to claim 7 in which the sprayed fluid is a gas.

9. A method of manufacturing a plasma display according to claim 6 in which the process for forming the inclined faces by the processing of the applied film is carried out by cutting the applied film.

10. A method of manufacturing a plasma display according to claim 5 or claim 6 in which the barrier rib paste is a photosensitive barrier rib paste and, in the process of forming the barrier rib pattern, the stripe-shaped barrier rib pattern is formed by exposing the aforesaid applied film of barrier rib paste through a photo mask having a stripe-shaped pattern which is longer than the length of the applied film with inclined faces as ends, and then developing.

11. A method of manufacturing a plasma display according to claim 4 which includes a process in which a barrier rib mother mould in which stripe-shaped grooves have been formed is filled with the barrier rib paste comprising inorganic material and organic component, a process in which the barrier rib paste filled in said barrier rib mother mould is transferred onto the substrate, and a process in which said barrier rib paste is fired, in that order.

12. A method of manufacturing a plasma display according to claim 4 which includes a process in which the barrier rib paste comprising inorganic material and organic component is applied onto the substrate to form an applied film, a process in which a barrier rib mother pattern in which stripe-shape grooves have been formed is pressed against said applied film and the barrier rib pattern formed, and a process in which said barrier rib pattern is fired, in that order.

13. A method of manufacturing a plasma display according to claim 4 in which the height (Y') of the inclined region and the length of the inclined region (X') prior to firing, and the shrinkage factor (r) of the barrier rib paste due to the firing have the following relationship $$0.5 \leqq X'/(r \times Y') \leqq 100.$$

14. A method of manufacturing a plasma display according to claim 4 where the height (Y') of the inclined region prior to firing is from 0.2 to 1 times the barrier rib pattern height prior to firing.

15. A method of manufacturing a plasma display according to claim 4 in which an applied film of dielectric paste comprising inorganic material and organic component is formed on the substrate, then a stripe-shaped barrier rib pattern is formed thereon using the barrier rib paste, after which the applied film of dielectric paste and the barrier rib pattern are simultaneously fired.

* * * * *